US007520603B2

(12) United States Patent
Tsuji et al.

(10) Patent No.: US 7,520,603 B2
(45) Date of Patent: Apr. 21, 2009

(54) INKJET PRINTER

(75) Inventors: Masaaki Tsuji, Wakayama (JP); Hiroomi Kondou, Wakayama (JP); Noboru Michiue, Wakayama (JP); Keiichi Yamamoto, Wakayama (JP); Yasuto Nakai, Wakayama (JP); Mitsuru Yasuda, Wakayama (JP)

(73) Assignee: Noritsu Koki Co., Ltd., Wakayama (JP)

( * ) Notice: Subject to any disclaimer, the term of this patent is extended or adjusted under 35 U.S.C. 154(b) by 547 days.

(21) Appl. No.: 11/255,186

(22) Filed: Oct. 21, 2005

(65) Prior Publication Data

US 2006/0087546 A1 Apr. 27, 2006

(30) Foreign Application Priority Data

| | | |
|---|---|---|
| Oct. 27, 2004 | (JP) | 2004-312507 |
| Oct. 27, 2004 | (JP) | 2004-312545 |
| Oct. 27, 2004 | (JP) | 2004-312567 |
| Oct. 27, 2004 | (JP) | 2004-312587 |
| Oct. 27, 2004 | (JP) | 2004-312602 |
| Oct. 27, 2004 | (JP) | 2004-312630 |
| Oct. 27, 2004 | (JP) | 2004-312669 |
| Nov. 8, 2004 | (JP) | 2004-324139 |
| Nov. 8, 2004 | (JP) | 2004-324141 |
| Nov. 8, 2004 | (JP) | 2004-324143 |

(51) Int. Cl.

| | |
|---|---|
| ***B41J 13/10*** | (2006.01) |
| ***B41J 13/08*** | (2006.01) |
| ***B41J 2/01*** | (2006.01) |
| ***B65H 3/44*** | (2006.01) |

(52) U.S. Cl. ..... 347/104; 400/608.1

(58) Field of Classification Search ..... None
See application file for complete search history.

(56) References Cited

U.S. PATENT DOCUMENTS 4,017,004 A * 4/1977 Onoe et al. ..... 221/94

(Continued)

FOREIGN PATENT DOCUMENTS

DE 4031246 A1 * 4/1992

(Continued)

OTHER PUBLICATIONS

Machine translation of DE 4031246 to Steinhilber et al. from EPO website.*

*Primary Examiner*—Daniel J Colilla
(74) *Attorney, Agent, or Firm*—Studebaker & Brackett PC; Donald R. Studebaker

(57) ABSTRACT

In an inkjet printer including first to n-th paper storages, such as a magazine type storage or a cassette type storage, and associated first to n-th upstream transport lines (where n is a natural number larger than 1), a paper carrier (switchback unit) is provided which has a roller pair reciprocable between any of first to n-th receive points corresponding to the downstream ends of the first to n-th upstream transport lines, respectively, and a forwarding point corresponding to the upstream end of a downstream transport line by means of a moving mechanism. The paper carrier is configured so that the roller pair receives and grips, at one of the first to n-th receive points, a sheet of printing paper transported from the associated upstream transport line, the moving mechanism moves the roller pair from the receive point to the forwarding point and the gripped sheet of printing paper is forwarded at the forwarding point to the downstream transport line.

2 Claims, 10 Drawing Sheets

U.S. PATENT DOCUMENTS 4,828,415 A * 5/1989 Hirono et al. ..... 400/605

FOREIGN PATENT DOCUMENTS

JP 60209446 A * 10/1985
JP 60236944 A * 11/1985
JP 09-086754 3/1997
JP 10-086411 4/1998
JP 11320995 A * 11/1999
JP 2000-289904 10/2000
JP 2000-352766 12/2000
JP 2001-033889 2/2001
JP 2002-090904 3/2002
JP 2003-237156 8/2003
JP 2003-260827 9/2003

* cited by examiner

INKJET PRINTER

CROSS-REFERENCES TO RELATED APPLICATIONS

This application claims priority under 35 USC 119 to Japanese Patent Applications Nos. 2004-324139, 2004-324141 and 2004-324143 filed on Nov. 8, 2004, and Japanese Patent Applications Nos. 2004-312507, 2004-312545, 2004-312602, 2004-312669, 2004-312567, 2004-312630 and 2004-312587 filed on Oct. 27, 2004, the entire contents of all of which are incorporated herein by reference.

BACKGROUND OF THE INVENTION (a) Field of the Invention

This invention relates to the technical field of inkjet printers configured to pull a sheet of printing paper out of a paper storage, feed the sheet of printing paper to a printing part and print on a printing surface of the sheet in the printing part.

(b) Description of the Related Art

Generally, inkjet printers used for photo printing systems comprise a paper storage in which a sheet or sheets of printing paper are set and a transport line for pulling the sheet of printing paper out of the paper storage and transporting it to a printing part.

The transport line in the inkjet printer of such kind is generally composed of a plurality of rollers for carrying a sheet of printing paper as disclosed in, for example, Japanese Unexamined Patent Publication No. 2003-237156.

In many inkjet printers of the above kind, printing is made on various types and formats of printing papers of different sizes. If in such cases the inkjet printer includes a single paper storage, the type or format of printing paper to be set in the paper storage must be changed according to need. To eliminate such inconvenience, like conventional photofinishing systems, inkjet printers of the above kind include two or more paper storages and are configured to selectively pull an appropriate format of printing paper out of the associated paper storage according to order information and feed it to the printing part (see, for example, Japanese Unexamined Patent Publications Nos. 2000-352766, 2001-33889 and 2002-90904).

In the transport line composed of a plurality of rollers as described above, the position of printing paper being transported changes more as the length of the transport line is increased because of individual differences or mounting errors of the rollers. Particularly, the printing paper being transported tends to change its orientation with respect to the direction of transport and its position in the width direction. Therefore, there exists a demand to minimize the length of the transport line composed of a plurality of rollers.

If the inkjet printer includes two or more paper storages as described above, two or more upstream transport lines are needed to pull various types or formats of printing papers out of the paper storages, respectively. In this case, in order to avoid that the two or more upstream transport lines significantly differ from one another in condition of printing paper being transported, it is desired to make the upstream transport lines equal in length or the number of rollers. In other words, it is desired to make the upstream transport lines equal in the position of printing paper being transported to the printing part (i.e., the orientation thereof with respect to the direction of transport and the position thereof in the width direction).

Even if, however, the above demands for the entire transport line and the upstream transport lines are satisfied in the inkjet printer of the above kind, this restricts the arrangement of paper storages and the arrangement of upstream transport lines, resulting in upsized inkjet printer.

SUMMARY OF THE INVENTION

The present invention has been made in view of the foregoing points and therefore its object is to provide an inkjet printer which includes two or more paper storages and two or more upstream transport lines and has a structure capable of satisfying the above demands for the entire transport line and the upstream transport lines without any restriction on the arrangements of paper storages and upstream transport lines.

To attain the above object, in the present invention, a paper carrier with a gripping member movable while gripping printing paper is placed partway along a transport line which connects between each of two or more paper storages and a printing part.

More specifically, an inkjet printer of the present invention comprises: first to n-th paper storages in each of which a sheet or sheets of printing paper are set, where n is a natural number larger than 1; first to n-th upstream transport lines, associated with the first to n-th paper storages, respectively, for individually pulling the sheet of printing paper out of the first to n-th paper storages and transporting the pulled-out sheet of printing paper; a printing part for printing on the printing surface of the sheet of the printing paper transported; a single downstream transport line for transporting the sheet of the printing paper to the printing part; and a paper carrier having a gripping member reciprocable between any of first to n-th receive points corresponding to the downstream ends of the first to n-th upstream transport lines, respectively, and a forwarding point corresponding to the upstream end of the downstream transport line by means of a moving mechanism.

In addition, the paper carrier is configured so that the gripping member receives and grips, at one of the first to n-th receive points, the sheet of printing paper transported from the associated upstream transport line, the moving mechanism moves the gripping member from said one receive point to the forwarding point and the gripped sheet of printing paper is forwarded at the forwarding point to the downstream transport line. Note that the above-mentioned downstream transport line is a line for transporting a sheet of printing paper to the printing part. For example, it may be a line for transporting a sheet of printing paper having been forwarded at the forwarding point by the paper carrier to the printing part as it is, or may be a line for subjecting a sheet of printing paper to an intermediate process between the upstream end of the downstream transport line and the printing part and then transporting the processed sheet of printing paper to the printing part.

Also note that the sheet of printing paper set in the first to n-th paper storages may be a long rolled sheet of printing paper or single sheets of printing paper and, therefore, the first to n-th paper storages include one or more magazine type storages in which a long rolled sheet of printing paper is set and/or one or more cassette type storages in which single sheets of printing paper are set. If at least one of the first to n-th paper storages is the magazine type storage, it is preferable that the associated upstream transport line for pulling the rolled sheet of printing paper out of the magazine type storage is provided with a cutter for cutting the rolled sheet of printing paper in a cut sheet of printing paper of predetermined length.

With the above configuration of the inkjet printer, the gripping member in the paper carrier moves between any one of the first to n-th receive points and the forwarding point to transport the sheet of printing paper. Therefore, even if the first to n-th paper storages are placed separately from each other, a sheet of the printing paper set in each of the first to n-th paper storages is selectively forwarded to the downstream transport line by the paper carrier. In other words, the first to n-th receive points can be individually set in correspondence with the downstream ends of the first to n-th upstream transport lines. This eliminates any constrains on the arrangement of a plurality of paper storages and the arrangement of a plurality of upstream transport lines and enhances the flexibilities of these arrangements, which is advantageous in downscaling the inkjet printer.

Further, the provision of the paper carrier facilitates equalizing the distances between each of the paper storages and their receive points (the lengths of the upstream transport lines) and making the upstream transport lines equal in number of component rollers, without restricting the arrangement of paper storages and the arrangement of upstream transport lines. Furthermore, the length of each upstream transport line can be shortened by a length for which the sheet of printing paper is transported by the gripping member of the paper carrier.

As a result, when the first to n-th upstream transport lines are each composed of rollers, it is prevented that the position of printing paper being transported is adversely affected on the way of the transport and the plurality of upstream transport lines are different from each other in the position of printing paper being transported. In other words, since the paper carrier is a device for transporting a sheet of printing paper so that the gripping member moves while gripping the sheet of printing paper but is not a device for transporting the sheet of printing paper by means of rollers, the position of the sheet of printing paper being transported by the paper carrier does not change on the way to the transport. Therefore, a sheet of printing paper from each paper storage is transported to the printing part under a condition that has a little effect on the printing quality, i.e., under a condition that the tilt to the direction of transport of the sheet of printing paper is not increased as compared to the case of transport using rollers. The provision of the paper carrier in the above manner permits the reduction of the total number of rollers for transporting printing paper from each paper storage to the printing part. In addition, the condition of printing paper being transported can be equalized among the plurality of upstream transport lines. For example, even if the plurality of upstream transport lines have different lengths, they can transport printing paper in the same transported position to the printing part.

Furthermore, when the moving mechanism moves the gripping member to the forwarding point, the paper carrier can transport the sheet of printing paper gripped by the gripping member, separated from the upstream transport lines. Therefore, the sheet of printing paper can be transported to the printing part without being affected by its setting in the associated paper storage.

Conventionally, if a long sheet of printing paper is continuously, i.e., without being cut, transported from the paper storage to the printing part, the sheet of printing paper is affected by its setting in the paper storage to tend to tilt with respect to the width direction of the sheet of printing paper. In the printing part, ink ejection nozzles of a print head are aligned in a line in the direction of transport of the printing paper. Therefore, if the long sheet of printing paper slightly tilts with respect to the width direction thereof, adhesion points of inks ejected from the upstream-end and downstream-end ejection nozzles are off in the width direction of the sheet of printing paper, this has an adverse effect on the printing quality.

In contrast, in the inkjet printer having the above paper carrier, the paper carrier can forward a sheet of printing paper, separated from the upstream transport lines, to the downstream transport line. According to the inkjet printer of the present invention, even a long sheet of printing paper or even a single sheet of printing paper can be transported to the printing part without being affected by its setting. In addition, since the length of the entire transport line from each paper storage to the printing part can be shortened by the length of a section of transport using the gripping member, the number of rollers for transporting printing paper can be reduced. As a result, the amount of skew of the sheet of printing paper caused by errors in roller shape can be reduced, which reduces the tilt of the sheet of printing paper in the width direction in the printing part, coupled with the forwarding of the sheet of printing paper to the downstream transport line in a form separated from the upstream transport lines. Hence, the printing quality can be improved.

The gripping member is preferably a roller pair composed of opposed rollers which are rotatable forward and in reverse around their respective central axes and pinch the sheet of printing paper therebetween. Thus, the gripping member can be easily implemented and the sheet of printing paper can be easily received and forwarded.

The paper carrier may be provided with a driving mechanism for rotating at least one roller of the roller pair around its central axis and may be configured so that the driving mechanism rotates the at least one roller for receiving and forwarding of a sheet of printing paper. Thus, the paper carrier not only can receive and grip the sheet of printing paper but also pull in and forward out the sheet of printing paper. This eliminates the need for additional rollers for pulling in and forwarding out the sheet of printing paper, thereby reducing the cost.

In the above inkjet printer, the paper carrier preferably has a function serving as a switchback device for forwarding the sheet of printing paper received by the gripping member opposite to the direction in which the sheet of printing paper has been received.

Specifically, in a preferable embodiment of this invention, the first to n-th upstream transport lines are arranged one above another and configured to transport the sheet of printing paper with the printing surface up, the downstream transport line is located above the first to n-th upstream transport lines and configured to transport the sheet of printing paper with the printing surface up in the direction opposite to the direction of transport in the upstream transport lines, and the paper carrier is configured so that the gripping member receives and grips, at one of the first to n-th receive points, the sheet of printing paper transported from the associated upstream transport line, the moving mechanism moves the gripping member from the receive point to the forwarding point located above the receive point and the gripped sheet of printing paper is forwarded at the forwarding point to the downstream transport line in the direction opposite to the direction of movement of the sheet of printing paper during receipt thereof.

With the above configuration, the paper carrier having a function serving as the switchback device can lead a sheet of printing paper, with the printing surface up, from any one of the upstream transport lines to the downstream transport line. Therefore, even if the upstream transport lines (or the paper storages) and the downstream transport line (or the printing part) are arranged the latter above the former, the sheet of printing paper can be transported to the printing part without being significantly bent.

If the upstream transport lines (or the paper storages) and the downstream transport line (or the printing part) are arranged substantially on the same level, the inkjet printer will have a horizontally elongated configuration, which requires a large occupied space. Therefore, these components are preferably arranged one above another. Further, in the inkjet printer, it is preferable to put a sheet of printing paper in the printing part with the printing surface up and eject ink against the printing surface from above. Conventionally, when the upstream transport lines (or the paper storages) and the downstream transport line (or the printing part) are arranged the latter above the former and a sheet of printing paper is continuously transported by rollers from the paper storage to the printing part, the sheet of printing paper after pulled out of the paper storage and transported upward must be turned over by rollers in order to take a horizontal position with the printing surface up in the printing part. Therefore, the sheet of printing paper is naturally forcedly bent by the rollers. As a result, in the case of a long rolled sheet of printing paper, the curl of the printing paper due to its roll set is aggravated. In the case of a single sheet of printing paper, it changes from having no curl to having a strong curl. To cope with this, the conventional inkjet printers suck the sheet of printing paper onto a printing table in the printing part in order to ensure the levelness of the sheet of printing paper in the printing part and improve the printing quality. However, when the curl of the printing paper is significant, this needs a large-sized suction device having a large suction force, which invites an increased occupied space and cost rise.

In contrast, as described above, the inkjet printer of the present invention with a paper carrier having a function serving as the switchback device eliminates the need to significantly bend back a sheet of printing paper, which is less likely to cause the sheet of printing paper to have a large curl. Therefore, the levelness of the sheet of printing paper in the printing part can be well ensured with a simple, compact suction device. Further, according to the conditions, there is a high possibility to ensure the levelness even if no suction device is provided. Particularly in the case of a single sheet of printing paper, the suction device can surely be dispensed with.

In the inkjet printer with the paper carrier having a function serving as the switchback device, the gripping member may be the above-mentioned roller pair, a driving mechanism may be provided for rotating at least one roller of the roller pair forward and in reverse around its central axis and the paper carrier may be configured so that the driving mechanism rotates the at least one roller forward and in reverse for receiving and forwarding of a sheet of printing paper. Thus, the direction of movement of the sheet of printing paper can be easily reversed between receiving and forwarding it by changing the direction of rotation of the roller.

In the inkjet printer with the paper carrier having a function serving as the switchback device, when at least one of the first to n-th paper storages is a magazine type storage, the upstream transport line for pulling a rolled sheet of printing paper out of the magazine type storage and the receive point corresponding to the downstream end of the upstream transport line are preferably located above the roll center of the rolled sheet of printing paper set in the magazine type storage. Thus, a void space having a height corresponding to the size (roll diameter) of the rolled sheet of printing paper is created below a region located on the opposite side of the gripping member to the upstream transport line and corresponding to the range of movement of the gripping member. This space can be effectively used. It may be considered that a space for a sheet of printing paper gripped by the gripping member is provided in a region located on the opposite side of the gripping member to the upstream transport line and corresponding to the range of movement of the gripping member. In this case, normally, the necessary dimension of the space along the direction of extension of the upstream transport line will be substantially equal to the length of a cut sheet of the rolled sheet of printing paper. In the inkjet printer with the above paper carrier, on the other hand, the space for a sheet of printing paper is extended downward, instead of horizontally, so that when the paper carrier receives a sheet of printing paper at the receive point and pulls it into the opposite side thereof to the upstream transport line, the sheet of printing paper can be drooped in the space. Therefore, the dimension of the space along the direction of extension of the upstream transport line can be minimized.

In addition, since the upstream transport line for pulling the rolled sheet of printing paper out of the magazine type storage and the receive point corresponding to the downstream end of the upstream transport line are located above the roll center of the rolled sheet of printing paper set in the magazine type storage, the rolled sheet of printing paper can be pulled out of the upper part of the roll and therefore can be easily pulled out of the paper storage with the printing surface up. Further, coupled with no need to bend back a sheet of the printing paper through from the upstream transport line to the downstream transport line, the upstream transport line and the downstream transport line can be placed in proximity to each other, which makes the inkjet printer compact vertically as well as horizontally. Furthermore, when the upstream transport line and the downstream transport line is placed in proximity to each other, the distance between the receive point and the forwarding point can be shortened, which shortens the time required for a stroke of the gripping member returning from the forwarding point to the receive point, i.e., a stroke of the gripping member during which any sheet of printing paper is not really transported.

In the inkjet printer with the paper carrier having a function serving as the switchback device, the paper carrier is preferably configured to move a sheet of printing paper in horizontally opposite directions between when receiving it and when forwarding it. Thus, the sheet of printing paper can be transported to the printing part substantially without being bent, which ensures the levelness of the sheet of printing paper in the printing part with further certainty.

In the inkjet printer of the present invention, when at least one of the first to n-th paper storages is a magazine type storage in which a long rolled sheet of printing paper is set, the paper carrier preferably has a function serving as a decurler for removing a curl of the rolled sheet of printing paper due to roll set.

Specifically, in a preferred embodiment of the present invention, at least one of the first to n-th paper storages is a magazine type storage in which a long rolled sheet of printing paper is set, the upstream transport line for pulling the rolled sheet of printing paper out of the magazine type storage is provided with a cutter for cutting the rolled sheet of printing paper in a cut sheet of printing paper of predetermined length, the gripping member in the paper carrier is a roller pair composed of opposed rollers which are rotatable forward and in reverse around the respective central axes thereof and pinch the sheet of printing paper transported from the associated upstream transport line, the downstream transport line is provided at the upstream end with a holding member for holding the leading end of the sheet of printing paper forwarded at the forwarding point from the paper carrier, and the paper carrier is configured so that after the sheet of printing paper cut in the predetermined length by the cutter starts to be forwarded from the forwarding point toward the downstream transport line, the moving mechanism moves the roller pair pinching the vicinity of the leading end of the cut sheet of printing paper, with the leading end of the cut sheet of printing paper of the predetermined length held by the holding member, from the forwarding point toward or away from the receive point where the cut sheet of printing paper has been received to pull the cut sheet of printing paper in a length direction thereof through between the roller pair against drag of the roller pair on the cut sheet to shift the part of the cut sheet of printing paper pinched by the roller pair from the vicinity of the leading end thereof toward the trailing end thereof thereby removing curl of the cut sheet of printing paper due to roll set.

With the above configuration, when the roller pair of the paper carrier moves from the forwarding point toward or away from the receive point where the cut sheet of printing paper has been received, the cut sheet of printing paper is wound on the roller of the roller pair situated in the rear in the direction of movement of the roller pair and a tension is applied to the cut sheet of printing paper between the holding member and the roller pair. With the movement of the roller pair, the cut sheet of printing paper is pulled in its length direction through between the roller pair against drag (i.e., frictional resistance) thereof on the cut sheet. Thus, the part of the cut sheet of printing paper being pinched (gripped) by the roller pair continuously shifts from the vicinity of the leading end toward the trailing end. In this case, the direction of movement of the roller pair can be determined by that the cut sheet of printing paper can be wound on the roller in a form bent opposite to the orientation of the curl. It is preferable that when the roller pair moves toward the receive point where the cut sheet of printing paper has been received, the cut sheet of printing paper can be wound on the roller in a form bent opposite to the orientation of the curl. Thus, the cut sheet of printing paper can be decurled while the roller pair returns to the receive point to receive the next sheet of printing paper.

To be more specific, since such a long rolled sheet of printing paper is normally rolled up with the printing surface out, its cut sheet is curled so that the middle portion thereof in the feeding direction rises on the printing surface side from both ends. Therefore, if the rollers of the roller pair are vertically opposed to each other and the roller pair is configured to vertically move and forward a sheet of printing paper to the downstream transport line with the printing surface up, it is desirable to locate the forwarding point above the receive point. Thus, when the roller pair moves from the forwarding point toward the receive point, the cut sheet of printing paper is wound on the upper roller of the roller pair in a form bent opposite to the orientation of the curl.

Therefore, the cut sheet of printing paper is pulled through between the roller pair against drag thereof on the cut sheet by applying a tension to the cut sheet of printing paper bent opposite to the orientation of the curl while pinching it between the roller pair. Therefore, even a significantly curled sheet of printing paper can be well decurled. According to this aspect of the invention, since a cut sheet of a long rolled sheet of printing paper is fed to the printing part after its curl owing to roll set is removed, the cut sheet of the rolled sheet of printing paper in the printing part can obtain a sufficient levelness with a small suction unit or without any suction unit.

The holding member is preferably a feeding roll for receiving a sheet of printing paper forwarded by the roller pair and feeding it to the printing part. Thus, the holding member can be implemented with a simple structure and can double as a feeding roller for feeding a sheet of printing paper to the printing part. In this case, while a cut sheet of the rolled sheet of printing paper is pulled through between the roller pair against drag thereof on the cut sheet by moving the roller pair, the feeding roll preferably holds the leading end of the cut sheet of printing paper while stopping the feeding of the cut sheet of printing paper.

In decurling a cut sheet of printing paper in the above manner, the amount of decurl of the cut sheet of printing paper can be controlled by changing factors relating to the roller pair, such as the moving speed of the roller pair moved by the moving mechanism, the length of part of the cut sheet of printing paper wound on the roller of the roller pair during the movement of the roller pair, or the diameter of the roller of the roller pair on which the cut sheet of printing paper is wound. Alternatively, the amount of decurl of the cut sheet of printing paper can be controlled by providing a driving mechanism for rotating at least one roller of the roller pair around its central axis during the decurling and changing the number of revolutions of the at least one roller driven by the driving mechanism. As the moving speed of the roller pair is decreased, the cut sheet of printing paper is pulled more slowly through between the roller pair so that the amount of decurl becomes larger. As the length of part of the cut sheet of printing paper wound on the roller is increased, the amount of decurl becomes larger. As the diameter of the roller on which the cut sheet of printing paper is wound is decreased, the amount of decurl becomes larger. Further, if the roller is rotated by the driving mechanism in the direction to pull the cut sheet of printing paper against the holding member, the greater the number of revolutions of the roller, the stronger the tension applied to the cut sheet of printing paper and the larger the amount of decurl. On the other hand, if the roller is rotated by the driving mechanism in the direction to make the cut sheet of printing paper slack, the smaller the number of revolutions of the roller, the stronger the tension applied to the cut sheet of printing paper and the larger the amount of decurl.

Also in the inkjet printer with the paper carrier having a function serving as the decurler, like the inkjet printer with the paper carrier having a function serving as the switchback device, it is preferable that the first to n-th upstream transport lines are arranged one above another and configured to transport a sheet of printing paper with the printing surface up and the downstream transport line is located above all the upstream transport lines and configured to transport the sheet of printing paper with the printing surface up. In addition, if at least one of the first to n-th paper storages is a magazine type storage, it is preferable that the upstream transport line for pulling out a rolled sheet of printing paper set in the magazine type storage and the receive point corresponding to the downstream end of the upstream transport line are located above the roll center of the rolled sheet of printing paper set in the magazine type storage. Thus, not only the rolled sheet of printing paper can be easily pulled out of the magazine type storage with the printing surface up, but also the upstream transport line can be placed in proximity to the downstream transport line, which reduces the distance between the receive point and the forwarding point to shorten the time for a stroke of the roller pair returning from the forwarding point to the receive point, i.e., a stroke during which any sheet of printing paper is not really transported. If the upstream transport line is placed in proximity to the downstream transport line, it may seem difficult to decurl a longer cut sheet of printing paper than the distance between the receive point and the forwarding point substantially over the entire length using only a stroke of the roller pair returning from the forwarding point to the receive point. Since, however, a void space having a height corresponding to the size (roll diameter) of the rolled sheet of printing paper is created below a region located on the opposite side of the gripping member to the upstream transport line and corresponding to the range of movement of the gripping member, this space can be used to decurl even a long cut sheet of printing paper substantially over the entire length.

In the inkjet printer of the present invention, if at least one of the first to n-th paper storages is a magazine type storage in which a long rolled sheet of printing paper is set, the paper carrier most preferably has both a function serving as the switchback device and a function serving as the decurler. This provides a compact inkjet printer having an extremely excellent printing quality.

In the inkjet printer with the paper carrier having a function serving as the decurler, suppose that it includes a single magazine type storage and a single cassette type storage, that the receive point corresponding to the downstream end of the first upstream transport line for pulling the long rolled sheet of printing paper out of the magazine type storage is defined as a first receive point, that the receive point corresponding to the downstream end of the second upstream transport line for pulling out and transporting one of single sheets of printing paper set in the cassette type storage is defined as a second receive point, and that the gripping member (roller pair) moves from the forwarding point toward the first receive point so that a cut sheet of the rolled sheet of printing paper is pulled in the length direction through between the gripping member against drag thereof on the cut sheet. In this case, the printing part, the cassette type storage and the magazine type storage are preferably arranged in this order along the direction of reciprocation of the gripping member.

With the above paper carrier, the operation of the gripping member returning to the first receive point in order to receive the next sheet of printing paper after feeding a long cut sheet of printing paper (a sheet of the rolled sheet of printing paper cut in a predetermined length) at the forwarding point to the downstream transport line is the same as the operation thereof moving from the forwarding point to the first receive point in order to decurl the long cut sheet of printing paper. Therefore, if the distance from the forwarding point to the first receive point is relatively long, the operation of the gripping member returning to the first receive point can double as the operation thereof decurling a long cut sheet of printing paper.

On the other hand, since it is unnecessary to decurl a single sheet of printing paper, there is no need for the operation of the gripping member returning to the first receive point to double as the operation thereof decurling the sheet of printing paper. Therefore, the distance from the forwarding point to the second receive point may be relatively short. Further, if the distance from the forwarding point to the second receive point is relatively short, the distance of movement of the gripping member can be reduced thereby reducing the time of transport of a single sheet of printing paper.

If, as described above, the printing part, the cassette type storage and the magazine type storage are arranged in this order from top down along the direction of reciprocation of the gripping member, the distance between the upstream end of the downstream transport line and the downstream end of the first upstream transport line, i.e., the distance between the forwarding point and the first receive point, is relatively long, while the distance between the upstream end of the downstream transport line and the downstream end of the second upstream transport line, i.e., the distance between the forwarding point and the second receive point, is relatively short. Therefore, the printing part, the cassette type storage and the magazine type storage can be arranged optimally for the structure for decurling a cut sheet of the rolled sheet of printing paper.

Preferably, the distance between the downstream end of the first upstream transport line and the upstream end of the downstream transport line is set to be equal to or longer than the length of the longest sheet of the rolled sheet of printing paper cut by the cutter placed in the first upstream transport line.

If the distance between the downstream end of the first upstream transport line and the upstream end of the downstream transport line is shorter than the length of the longest cut sheet of rolled sheet of printing paper, the gripping member must return to the first receive point in order to receive the next sheet of rolled sheet of printing paper after it moves from the forwarding point to beyond the first receive point in order to decurl the preceding long cut sheet of rolled sheet of printing paper. In this case, the efficiency of paper transport is decreased and in turn the printing process efficiency is decreased.

In contrast, if the distance between the downstream end of the first upstream transport line and the upstream end of the downstream transport line is set to be equal to or longer than the length of the longest cut sheet of rolled sheet of printing paper, decurling over the entire length of the cut sheet of rolled sheet of printing paper can be completed only by the movement of the gripping member from the forwarding point to the first receive point. As a result, the efficiency of paper transport is increased and in turn the printing process efficiency is increased.

The printing part, the cassette type storage and the magazine type storage are preferably arranged so that the printing part is located above the others and the magazine type storage is located below the others.

Thus, the operator can easily set a long rolled sheet of printing paper in the magazine type storage located at a low level. In addition, since the sheet of printing paper printed in the printing part located at a high level is delivered at a high point on the outside of the inkjet printer, the operator can easily pick up the printed paper sheet.

If the printing part, the cassette type storage and the magazine type storage are arranged substantially on the same level, the inkjet printer will be elongated from side to side, which requires a large occupied space. In contrast, if the printing part, the cassette type storage and the magazine type storage are arranged one above another, the inkjet printer is made compact thereby saving the occupied space.

In the inkjet printer of the present invention, suppose that the first to n-th upstream transport lines are arranged one above another and configured to transport a sheet of printing paper with the printing surface up, that the downstream transport line is located above all the upstream transport lines and configured to transport the sheet of printing paper with the printing surface up, and that at least one of the first to n-th upstream transport lines is the magazine type storage as described above. In this case, it is preferable that a space in which a sheet of printing paper gripped by the gripping member droops is created on the opposite side of the gripping member to the upstream transport lines and the distance between the downstream end of the upstream transport line connecting to the magazine type storage and the bottom of the space is set to be equal to or longer than the length of the longest cut sheet of a rolled sheet of printing paper cut by the cutter placed in the upstream transport line.

The gripping member normally receives a long rolled sheet of printing paper (a sheet of a rolled sheet of printing paper cut in a predetermined length) or a single sheet of printing paper at the receive point and pulls it into the opposite side thereof to the upstream transport lines. Therefore, a space for a sheet of printing paper gripped by the gripping member is needed on the opposite side of the gripping member to the upstream transport lines. If the space is provided to extend along the upstream transport lines, the necessary dimension of the space along the direction of extension of the upstream transport lines normally will be substantially the same as the length of the longest sheet of printing paper gripped by the gripping member.

In contrast, since in the present invention a sheet of printing paper is gripped in a drooping form by the gripping member when the gripping member pulls the sheet of printing paper, which has been received at the receive point, into the opposite side thereof to the upstream transport lines, and transported to the forwarding point as it droops, the dimension of the space along the direction of extension of the upstream transport lines can be reduced.

In addition, since the distance between the downstream end of the upstream transport line connecting to the magazine type storage and the bottom of the space, i.e., the distance between the receive point for a long rolled sheet of printing paper and the bottom of the space, is set to be equal to or longer than the length of the longest sheet of the rolled sheet of printing paper cut by the cutter, a long cut sheet of the rolled sheet of printing paper can be prevented from touching the bottom defining the space when gripped by the gripping member. Thus, the sheet of printing paper can be prevented from producing creases and adsorbing contaminants, which ensures the printing quality.

The printing part and the first to n-th paper storages may be arranged the former above the latter and the paper carrier may be placed to the sides of the printing part and the paper storages and configured to vertically reciprocate.

Thus, the inkjet printer can be made horizontally compact and the occupied space for the inkjet printer can be made small. Further, since a sheet of printing paper is carried by the paper carrier, it can be fed to the printing part without being significantly bent even if the printing part and the paper storages are arranged the former above the latter and the magazine type storage, the cassette type storage and the printing part can be placed in proximity to each other, which makes the inkjet printer compact vertically as well as horizontally.

The magazine type storage may be placed below one or more cassette type storages and the receive point corresponding to the downstream end of the upstream transport line connecting to the magazine type storage may be located above the roll center of a rolled sheet of printing paper set in the magazine type storage.

Thus, a void space having a height corresponding to the size (roll diameter) of the rolled sheet of printing paper set in the magazine type storage is created on the opposite side of the gripping member to the magazine type storage. This void space can be effectively used as the above-mentioned space for drooping a sheet of printing paper. Though the necessary distance between the downstream end of the upstream transport line connecting to the magazine type storage and the bottom of the space for drooping a sheet of printing paper is equal to or longer than the length of the longest cut sheet of the rolled sheet of printing paper, the void space having a height corresponding to the roll diameter can be easily appropriated for the distance. As a result, the inkjet printer can be made vertically compact.

On the contrary, one or more cassette type storages may be placed below the magazine type storage.

In this case, since the magazine type storage is located at a high level, the level of the downstream end of the upstream transport line connecting to the magazine type storage is also relatively high. Therefore, a space created on the opposite side of the gripping member to the cassette type storages can be used as the space for drooping a sheet of printing paper, which makes the inkjet printer vertically compact while supporting the printing of a considerably long sheet of printing paper.

If the inkjet printer includes two or more cassette type storages in which different types of single sheets of printing paper having different lengths are set, the two or more cassette type storages are preferably arranged from top down in the order of increasing length of single sheets of printing paper set therein.

Thus, the downstream end of the upstream transport line connecting to the cassette type storage for longer single sheets of printing paper is located at a relatively higher level, while the downstream end of the upstream transport line connecting to the cassette type storage for shorter single sheets of printing paper is located at a relatively lower level. Therefore, a space created on the opposite side of the gripping member to the cassette type storages arranged one above another can be used as the space for drooping a sheet of printing paper, which makes the inkjet printer vertically compact.

DETAILED DESCRIPTION OF THE INVENTION

Embodiments of the present invention will be described below in detail with reference to the drawings.

Figure 1:
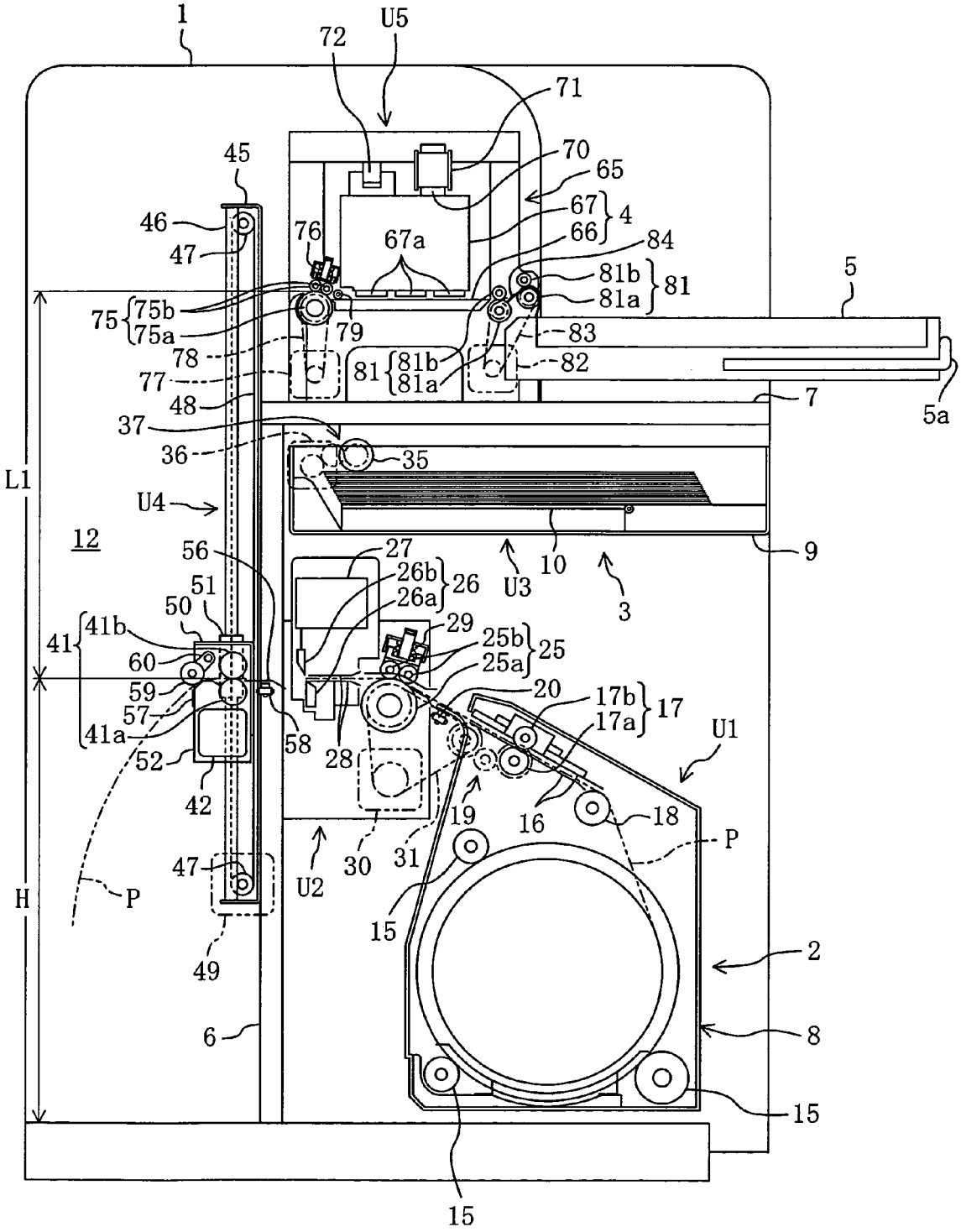
FIG. 1 is a schematic diagram showing the structure of an inkjet printer according to an embodiment of the present invention when viewed from the side of a housing.

FIG. 1 shows an inkjet printer according to an embodiment of the present invention. This inkjet printer is used for photo printing systems, connected via a communication cable to an information receiving block 100 (see FIG. 8) for obtaining image data and order information and executing necessary processing such as correction, and configured to print the image data transmitted from the information receiving block 100 via the communication cable on a sheet of printing paper P according to the order information.

The inkjet printer comprises a housing 1, a magazine type storage 2 placed in the housing 1 toward its bottom, a cassette type storage 3 placed in the housing 1 substantially in its vertical middle, a printing part 4 placed in the housing 1 toward its top to print image data on a sheet of printing paper P, a first transport line for transporting a sheet of printing paper P from the magazine type storage 2 to the printing part 4, a second transport line for transporting a sheet of printing paper P from the cassette type storage 3 to the printing part 4, a third transport line for ejecting a sheet of printing paper P printed in the printing part 4 from the printing part 4 to the outside of the housing 1, and a delivery tray 5 placed at the outside of the housing 1 to receive a sheet of printing paper P ejected through the third transport line to the outside of the housing 1. Note that the front-to-rear direction of the housing 1 is indicated by the lateral direction in FIG. 1, the front side of the housing 1 is the right side in FIG. 1, the rear side of the housing 1 is the left side in FIG. 1 and the lateral direction of the housing 1 is the direction perpendicular to the paper plane of FIG. 1.

A long rolled sheet of printing paper P can be set in the magazine type storage 2 so that it is held in a paper magazine 8. The rolled sheet of printing paper P is rolled up with its printing surface outside. On the other hand, a plurality of single sheets of printing paper P can be set in the cassette type storage 3 so that they are held in a rectangular box-shaped paper feed cassette 9. The single sheets of printing paper P in the paper feed cassette 9 are stacked one on another in their thickness direction (vertically) with their printing surfaces up and pushed against the after-mentioned forwarding roller 35 located above them by a pushing plate 10. The magazine type storage 2 constitutes a first paper storage in which a rolled sheet of printing paper P is set, while the cassette type storage 3 constitutes a second paper storage in which single sheets of printing paper P are set. In printing, either a cut sheet of the rolled sheet of printing paper P in the magazine type storage 2 or a single sheet of printing paper P in the cassette type storage 3 is fed to the printing part 4, printed therein and then ejected to the delivery tray 5. In the magazine type storage 2, two rolled sheets of printing paper P of shorter width can be set in parallel in the right-to-left direction of the housing 1. When two rolled sheets of printing paper P are set in parallel in this manner, the two rolled sheets of printing paper P are concurrently pulled out of the magazine type storage 2 and transported in two lines and respective cut sheets of the two rolled sheets are concurrently printed in the printing part 4 and then ejected to the delivery tray 5.

In the housing 1, a first supply unit U1, a cutter unit U2, a second supply unit U3, a switchback unit U4 and a printing unit U5 are disposed to constitute the first to third transport lines. The first transport line is composed of, in the order from the magazine type storage 2, the first supply unit U1, the cutter unit U2, the switchback unit U4 and the printing unit U5. The second transport line is composed of, in the order from the cassette type storage 3, the second supply unit U3, the switchback unit U4 and the printing unit U5. The third transport line is composed of the printing unit U5.

The first supply unit U1 is disposed in the magazine type storage 2 (specifically, the paper magazine 8). The first supply unit U1 includes three support rollers 15 for supporting a rolled sheet of printing paper P, a guide member 16 for guiding the rolled sheet of printing paper P to the cutter unit U2, a pinch supply roller assembly 17 formed of drive and driven rollers 17*a* and 17*b* placed partway along the guide member 16 to transport the rolled sheet of printing paper P to the cutter unit U2, and a guide roller 18 which is placed upstream of the guide member 16 and on which the rolled sheet of printing paper P is wound. One of the three support rollers 15 placed toward the front of the housing 1 is driven into rotation by an unshown electric motor to apply to the rolled sheet of printing paper P a force to rotate itself about the roll center. The drive roller 17*a* of the supply roller assembly 17 is driven into rotation, together with a drive roller 25*a* of the after-mentioned forwarding roller assembly 25 placed in the cutter unit U2, via a drive belt 31 and a gear set 19 by an electric motor 30 placed in the cutter unit U2. A first paper detecting sensor 20 is disposed at the downstream end of the first supply unit U1. The first paper detecting sensor 20 detects the trailing edge of the rolled sheet of printing paper P when the entire rolled sheet of printing paper P has been pulled out of the magazine type storage 2. When the trailing edge of the rolled sheet of printing paper P has been detected, the operator is informed of this fact through a display or other means.

The cutter unit U2 includes a pinch forwarding roller assembly 25 placed at a location closer to the rear of the housing 1 than the first supply unit U1 and fixed to a vertically extending frame 6 (hereinafter, referred to as a vertical frame 6) to forward the rolled sheet of printing paper P to the switchback unit U4, a cutter 26 composed of fixed and movable blades 26*a* and 26*b* for cutting the rolled sheet of printing paper P in a cut sheet, a cutter drive 27 accommodating a drive mechanism for driving the movable blade 26*b*, and a horizontally extending guide member 28 for guiding the rolled sheet of printing paper P from the forwarding roller assembly 25 to the cutting point for the cutter 26. The cutter 26 cuts the rolled sheet of printing paper P, which has been pulled out of the magazine type storage 2, into a cut sheet of printing paper of predetermined length according to the order information from the information receiving block 100. The forwarding roller assembly 25 is composed of a single drive roller 25*a* and two driven rollers 25*b* to pinch the rolled sheet of printing paper P among them. For this purpose, the two driven rollers 25*b* are pushed against the drive roller 25*a* by a single compression coil spring 29. As already described, the drive roller 25*a* is driven into rotation, together with the drive roller 17*a* of the supply roller assembly 17 in the first supply unit U1, via the drive belt 31 by the electric motor 30. The rolled sheet of printing paper P is forwarded in a horizontal position toward the rear of the housing 1 to the switchback unit U4 by the forwarding roller assembly 25 and the guide member 28, received and gripped by a roller pair 41 in the switchback unit U4 as described later, and then cut into the predetermined length by the cutter 26. Instead of receiving the rolled sheet of printing paper P before cut, the roller pair 41 may receive a sheet of printing paper already cut. In this case, however, the transport line in the cutter unit U2 needs to be elongated. Therefore, the rolled sheet of printing paper P is preferably received by the roller pair 41 before it is cut.

The second supply unit U3 includes a forwarding roller 35 which abuts the printing surface of the uppermost of a plurality of sheets of printing paper (single sheets of printing paper) P set in the cassette type storage 3, and an electric motor 36 for driving the forwarding roller 35 via a gear set 37. When the forwarding roller 35 is driven, only the uppermost single sheet of printing paper P in the cassette type storage 3 is forwarded in a horizontal position toward the rear of the housing 1 to the switchback unit U4.

The switchback unit U4 constitutes a paper carrier and switchback device placed partway along the first and second transport lines. The switchback unit U4 receives a sheet of printing paper P transported via a first upstream transport line (i.e., the first supply unit U1 and the cutter unit U2) or a second upstream transport line (i.e., the second supply unit U3) both located upstream of the switchback unit U4, and forwards it, in the direction opposite to the direction of movement of the sheet of printing paper P during receipt of it, to a downstream transport line (i.e., the printing unit U5) located downstream of the switchback unit U4. Specifically, in the first and second upstream transport lines, a sheet of printing paper P is transported toward the rear of the housing 1 with the printing surface up. In contrast, in the downstream transport line disposed above both the upstream transport lines, a sheet of printing paper P is transported toward the front of the housing 1 with the printing surface up. In the switchback unit U4 located between the upstream and downstream transport lines, the direction of transport of the sheet of printing paper P is reversed as the printing surface remains faced up, so that the sheet of printing paper P can be smoothly transported from either of the upstream transport lines to the downstream transport line without being bent with any roller.

More specifically, the switchback unit U4 includes a gripping member for receiving and gripping a sheet of printing paper P transported through the first or second upstream transport line. In this embodiment, the gripping member is constituted by a pinch roller assembly, i.e., a pair of vertically opposed rollers 41 configured to rotate forward and in reverse about their central axes and pinch a sheet of printing paper P therebetween. One roller of the roller pair 41 (the roller contacting the back of the sheet of printing paper P in this embodiment) is a drive roller 41*a*, while the other (the roller contacting the printing surface of the sheet of printing paper P) is a driven roller 41*b*. The drive roller 41*a* is driven into forward and reverse rotation about its central axis by an electric motor 42 and a drive belt 43 (see FIGS. 2 and 3) which constitute a drive mechanism. First, the drive roller 41*a* is rotated forward so that a sheet of printing paper P is pulled in from the first or second upstream transport line and received. Then, the drive roller 41*a* is rotated in reverse so that a sheet of printing paper P is forwarded to the downstream transport line. The relation between the drive and driven rollers may be inverted or both rollers of the roller pair 41 may be driven by the drive mechanism.

Figure 2:
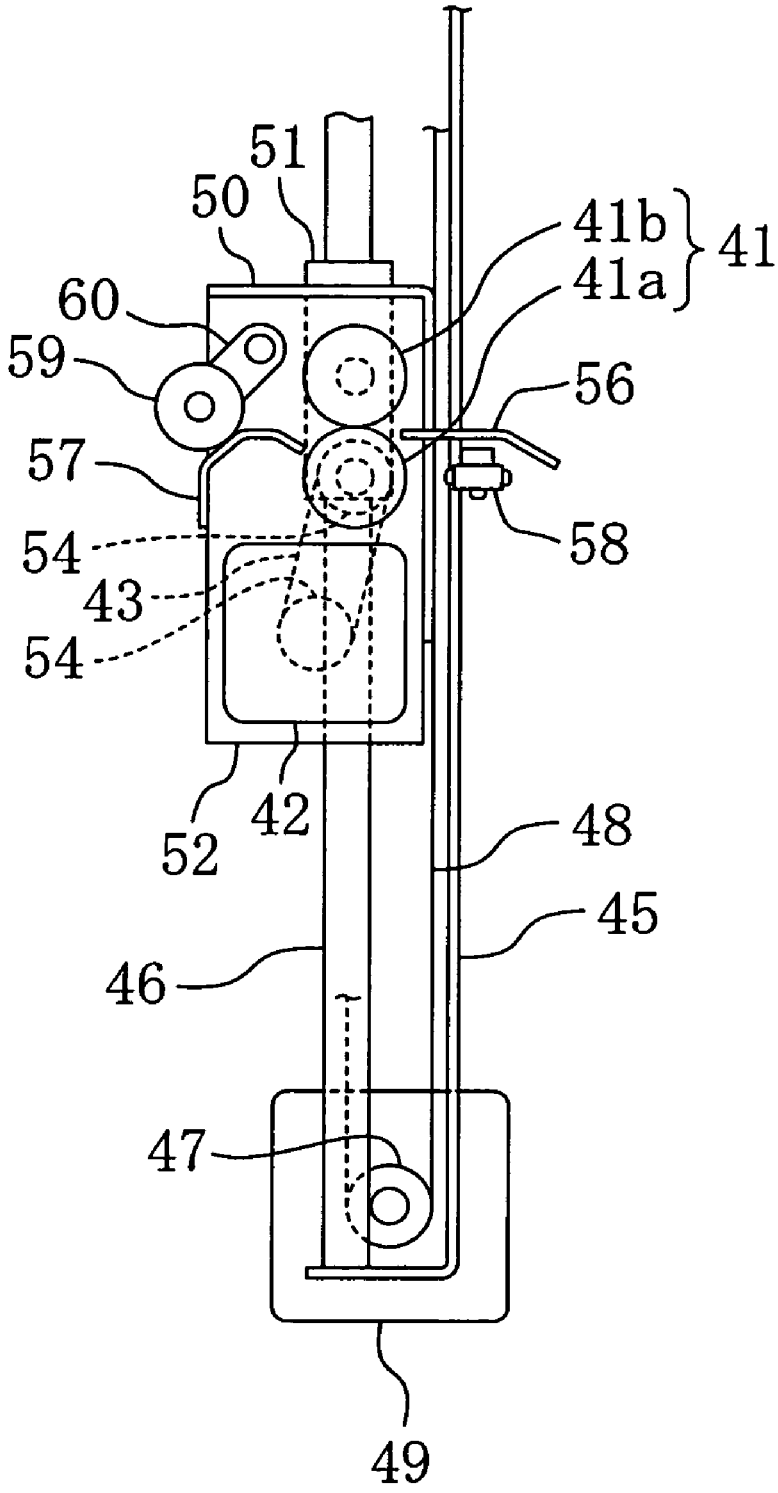
FIG. 2 is a diagram showing the structure of a switchback unit when viewed from the side of the housing.
Figure 3:
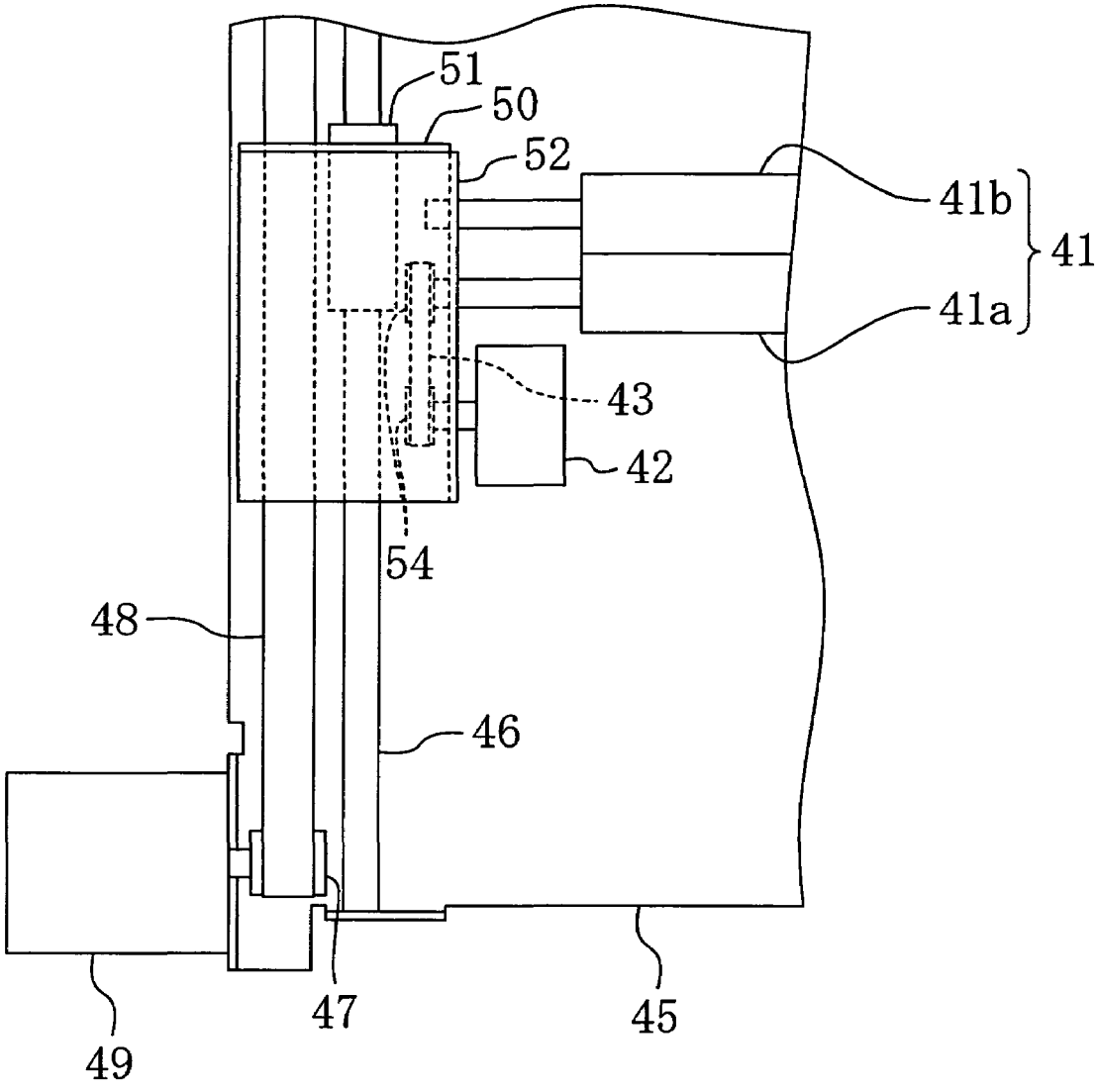
FIG. 3 is a diagram showing essential parts of the switchback unit when viewed from behind the housing.

The roller pair 41 is vertically and linearly moved at a location closer to the rear of the housing 1 than the cutter unit U2, the second supply unit U3 and the printing unit US by means of a moving mechanism. As shown in FIGS. 2 and 3, the moving mechanism comprises a rail mount 45 secured to the vertical frame 6 and extending in the vertical and lateral directions of the housing 1, a track rail 46 mounted to one lateral end of the rail mount 45 to extend vertically, a drive belt 48 wound around two pulleys 47 disposed in the respective vicinities of both vertical ends of the track rail 46 and extending along the track rail 46, and an electric motor 49 securely mounted to the rail mount 45 and directly connected to the lower pulley 47. The electric motor 49 drives the drive belt 48 forward and in reverse. A bracket 50 is fixedly attached to the drive belt 48. A sliding member 51 is secured to the bracket 50 and slidably fitted on the track rail 46. Thus, when the electric motor 49 rotates the drive belt 48 forward and in reverse, the bracket 50 reciprocates vertically. The vertical position of the bracket 50 can be determined by measuring its amount of movement (such as the number of revolutions of the motor) from the reference point (e.g., lowermost position) at which a sensor or the like for detecting the bracket 50 is placed.

A support plate 52 is fixed to the bracket 50, and either right ends or left ends of the shafts of the drive and driven rollers 41*a* and 41*b* of the roller pair 41 are rotatably supported to the support plate 52. Thus, with the movement of the bracket 50, the roller pair 41 moves vertically and linearly. Though not shown, the other ends of the shafts of the drive and driven rollers 41*a* and 41*b* are vertically slidably supported to a support part formed at the other lateral end of the rail mount 45.

The electric motor 42 for driving the drive roller 41*a* is secured to the support plate 52. Two pulleys 54 and 54 are fixed to one end of the rotating shaft of the electric motor 42 and one end of the shaft of the drive roller 41*a*, respectively. The drive belt 43 is wound around both the pulleys 54 and 54. Thus, the drive roller 41*a* can be driven via the drive belt 43.

The moving mechanism allows the roller pair 41 to reciprocate between each of first and second receive points corresponding to the respective downstream ends of the first and second upstream transport lines and the forwarding point corresponding to the upstream end of the downstream transport line. Specifically, a point on the track rail 46 substantially on the same level as the downstream end of the cutter unit U2 (the vicinity of the lower end of the track rail 46) corresponds to the first receive point at which a sheet of printing paper P is received from the cuter unit U2, while a point on the track rail 46 substantially on the same level as the downstream end of the second supply unit U3 (a substantially vertically middle of the track rail 46) corresponds to the receive point (hereinafter, referred to as the second receive point) at which a single sheet of printing paper P is received from the second supply unit U3. On the other hand, a point on the track rail 46 on the same level as the upstream end of the printing unit U5 (the vicinity of the upper end of the track rail 46) corresponds to the forwarding point at which a cut sheet or single sheet of printing paper P is forwarded to the printing unit U5. As seen from the above, the downstream ends of the first and second upstream transport lines are away from the upstream end of the downstream transport line by predetermined distances (minimum values depending on the arrangement of the units U1 to U5), respectively. The first and second receive points are accordingly away from the forwarding point by predetermined distances, respectively. The roller pair 41 reciprocates the predetermined distances between each of the first and second receive points and the forwarding point.

The switchback unit U4 is configured so that after the roller pair 41 receives and grips, at the first receive point, a rolled sheet of printing paper P from the first upstream transport line (the cutter unit U2) and the cutter 26 cuts the rolled sheet of printing paper P into a cut sheet of printing paper of predetermined length, the moving mechanism moves the roller pair 41 gripping the cut sheet of printing paper P to the forwarding point and forwards the cut sheet of printing paper P at the forwarding point to the downstream transport line in the opposite direction to the direction of movement of the rolled sheet of printing paper P during receipt of it. The switchback unit U4 is also configured so that after the roller pair 41 receives and grips, at the second receive point, a single sheet of printing paper P from the second upstream transport line (the second supply unit U3), the moving mechanism moves the roller pair 41 gripping the single sheet of printing paper P to the forwarding point and forwards the single sheet of printing paper P at the forwarding point to the downstream transport line in the opposite direction to the direction of movement of the single sheet of printing paper P during receipt of it. Therefore, the direction of movement of the sheet of printing paper P when forwarded to the downstream transport line is horizontally opposite to the direction of movement thereof during receipt of it (i.e., toward the front of the housing 1).

As shown in FIG. 2, first and second support members 56 and 57 (not shown in FIG. 3) are secured to the support plate 52 toward the front and rear, respectively, of the housing 1. The first and second support members 56 and 57 support a sheet of printing paper P gripped by the roller pair 41 from below.

The first support member 56 acts to guide the sheet of printing paper P in a horizontal position from the cutter unit U2 to the roller pair 41. The first support member 56 is provided with a second paper detecting sensor 58 for detecting the sheet of printing paper P.

On the other hand, the rear part of the second support member 57 is formed into a downwardly bent part. A pressing roller 59 abuts the downwardly bent part. The pressing roller 59 is rotatably attached to the distal end of an arm 60 pivotally supported to the support plate 52. The pressing roller 59 abuts the downwardly bent part of the second support member 57 under its own weight. The downwardly bent part of the second support member 57 and the pressing roller 59 allows the sheet of printing paper P gripped by the roller pair 41 to droop under its own weight and prevents it from abutting the rear wall of the housing 1. Specifically, a space 12 for a sheet of printing paper P gripped by the roller pair 41 is required in the housing 1 behind the switchback unit U4 (an inner region of the housing 1 located on the opposite side of the roller pair 41 to the first and second upstream transport lines and the downstream transport line and corresponding to the range of movement of the roller pair 41). If the above configuration is adopted for letting a sheet of printing paper P droop, this permits the minimization of the dimension of the space 12 in the front-to-rear direction of the housing 1 (in the direction of extension of the first and second upstream transport lines). In this case, it may be necessary on the other hand to extend the space 12 for a sheet of printing paper P gripped by the roller pair 41 to below the region corresponding to the range of movement of the roller pair 41 (below the first receive point). In this embodiment, however, the first upstream transport line and the first receive point both upstream of the switchback unit U4 is located above the roll center of the rolled sheet of printing paper P set in the magazine type storage 2. This permits an easy downward extension of the space 12 without increasing the height of the housing 1. In FIG. 2, H denotes the distance between the downstream end of the cutter unit U2 (i.e., the first receive point) and the bottom of the space 12. The distance H is set at a value equal to or longer than the length of the longest sheet of the rolled sheet of printing paper P cut by the cutter unit U2.

Though not shown, right and left restriction members for restricting the movement of a sheet of printing paper P in the width direction are placed at both lateral end parts, respectively, of each of the first and second support members 56 and 57 (both end parts thereof in the width direction of the sheet of printing paper P). Both the restriction members are configured to change the distance between them according to the paper width (determined by detecting the identification code assigned to each paper magazine 8). When two lines of sheets of printing paper P are transported in parallel as described above, an additional restriction member comes out on the transport line at the intermediate point between the right and left restriction members, so that the three restriction members can restrict the movement of the parallel-transported sheets of printing paper P in the width direction.

The printing unit U5 includes a fixed mount 65 fixed on the horizontal frame 7 extending horizontally at the upper end of the vertical frame 6, a printing table 66 placed in the vertical middle of the fixed mount 65 to support a sheet of printing paper P during printing, and a print head 67 placed to face the sheet of printing paper P put on the printing table 66 and print it by ejecting ink onto it. The printing table 66 and the print head 67 constitute the printing part 4.

Figure 4:
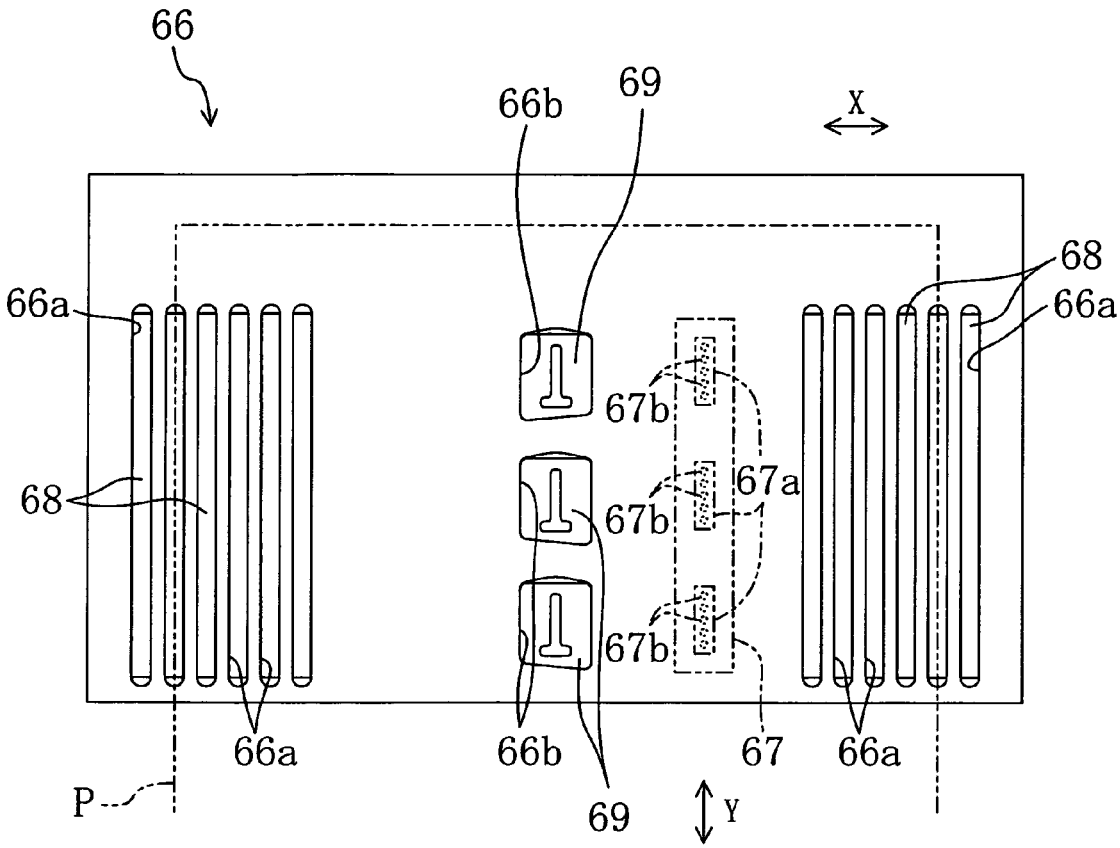
FIG. 4 is a plan view showing a printing table.

The printing table 66 does not have a configuration in which a sheet of printing paper P is held by suction from below the printing table 66 with a fan or the like, and therefore has no suction hole as shown in FIG. 4. Each of end portions of the top surface of the printing table 66 in the paper width direction (the direction of X in FIG. 4) are formed with a plurality (six for each side) of grooves 66*a* which extends in the direction of transport of the sheet of printing paper P (the direction of Y in FIG. 4) and are aligned at regular intervals in the paper width direction. The grooves 66*a* are disposed to correspond to the widthwise end positions of sheets of printing paper of various sizes. Each groove 66*a* is fitted with an ink absorbing material 68 for absorbing ink when the ink ejected from the print head 67 is off the widthwise ends of the sheet of printing paper P (this case is likely to take place particularly in creating borderless prints). The middle portion of the printing table 66 in the paper width direction is formed with recesses 66*b* at positions corresponding to the after-mentioned three head units 67*a*. The recesses 66*b* are fitted with ink absorbing materials 69, respectively, for absorbing ink previously ejected from the corresponding head units 67*a* of the print head 67 (ejected on a trial base prior to printing) in transporting and printing the sheets of printing paper P in two lines.

In this embodiment, as shown in FIG. 4, the print head 67 has three head units 67*a* in each of which the bottom surface (the surface opposed to the printing table 66) is formed with a plurality of ink ejection nozzles 67*b* aligned in the sub-scanning direction (the direction of transport of a sheet of printing paper P or the direction of Y). The three head units 67*a* are spaced away from one another in the sub-scanning direction. Though a single nozzle row is shown for each head unit 67*a* in FIG. 4, a plurality of nozzle rows corresponding to the number of ink colors used are actually arranged in the paper width direction. The number of head units 67*a* is not limited to three but may be one, two, four or more.

The top surface of the print head 67 is secured to a drive belt 70 for reciprocating the print head 67 in the main-scanning direction (the direction perpendicular to the paper plane of FIG. 1 or the direction of X in FIG. 4). The drive belt 70 extends in the main-scanning direction and is wound around two pulleys 71 (only one shown in FIG. 1) disposed at both ends of the belt 70 and rotatably supported to an upper part of the fixed mount 65. One of the pulleys 71 is driven into rotation by an unshown electric motor. A guide rail 72 is attached to the upper part of the fixed mount 65 to extend in the main-scanning direction along the drive belt 70. The print head 67 is reciprocated in the main-scanning direction by the drive belt 70 while being guided by the guide rail 72. The sheet of printing paper P on the printing table 66 is fed intermittently (stepwise) in certain unit amounts of feed in the sub-scanning direction by a feeding roller assembly 75 placed upstream of the printing table 66. During each stop in the intermittent feeding of the sheet of printing paper P, the print head 67 carries out a single scanning (with a single forward movement or a single backward movement) in the main-scanning direction. During a single scanning, ink is ejected, at each necessary point in the main-scanning direction, from the ink ejection nozzles 67*b* of each head unit 67*a*. In other words, after a single scanning of the print head 67, the sheet of printing paper P is fed by a unit amount of feed and then the print head 67 carries out a single scanning again. A desired image is printed by repeating the above operation.

The feeding roller assembly 75 is placed at the upstream end of the printing unit U5 (i.e., at the upstream end of the downstream transport line and in the vicinity of the roller pair 41 coming to the forwarding point (see FIG. 5)). The feeding roll 75 acts to receive a sheet of printing paper P forwarded from the roller pair 41 coming to the forwarding point and feed it to the printing part 4. The feeding roller assembly 75 is composed of, like the forwarding roller assembly 25 in the cutter unit U2, a single drive roller 75*a* and two driven rollers 75*b* which pinch the sheet of printing paper P among them.

The two driven rollers 75*b* are pushed against the drive roller 75*a* by a single compression coil spring 76. The drive roller 75*a* is driven into rotation via a drive belt 78 by an electric motor 77.

The feeding roller assembly 75 is positioned so that the level of part of a sheet of printing paper P pinched by the feeding roller assembly 75 is higher than that of the top surface of the printing table 66. Therefore, the sheet of printing paper P enters from obliquely above onto the printing table 66 while being wound on the drive roller 75*a*. Then, the sheet of printing paper P entering onto the printing table 66 is bent opposite to the direction of curvature of the part thereof wound on the drive roller 75*a*, by means of a guide roller 79 supported to the upstream end of the printing table 66 to create a clearance with the top surface thereof, and thereby fed with the back of the sheet of printing paper P substantially in contact with the top surface of the printing table 66.

On the other hand, downstream of the printing table 66, two pinch ejection roller assemblies 81 and 81 each formed of drive and driven rollers 81*a* and 81*b* are placed away from each other in the direction of transport of a sheet of printing paper P to form the third transport line for ejecting the printed sheet of printing paper P to the outside of the housing 1. The drive rollers 81*a* and 81*a* of both the ejection roller assemblies 81 and 81 are concurrently driven by an electric motor 82 via a drive belt 83. The level of the downstream-side ejection roller assembly 81 is higher than the upstream-side ejection roller assembly 81. Further, a guide member 84 is placed between the downstream-side and upstream-side ejection roller assemblies 81 and 81 to raise the sheet of printing paper P and guide it to the downstream-side ejection roller assembly 81.

Since, in the above manner, the sheet of printing paper P is raised to higher level than the top surface of the printing table 66 upstream and downstream of the printing table 66, part of the sheet of printing paper P above the printing table 66 is pushed against the printing table 66. This ensures the levelness of the sheet of printing paper P on the printing table 66. In particular, the sheet of printing paper P transported from the magazine type storage 2 is curled owing to roll set so that its middle portion in the direction of transport rises on the printing surface side from both ends. Even such a curled sheet of printing paper P can ensure levelness without the need to suck it onto the printing table 66. In this embodiment, as described later, the sheet of printing paper P transported from the magazine type storage 2 has already been decurled prior to the feeding onto the printing table 66. Therefore, according to this embodiment, the levelness of the sheet of printing paper P can be improved to a greater extent.

The delivery tray 5 is disposed at the outside of the housing 1 frontward of the upstream ejection roller assemblies 81 to extend beyond the front of the housing 1, and has an extendable tray 5*a* contained in the front end part thereof. The extendable tray 5*a* is configured to receive a longer, ejected sheet of printing paper P than the delivery tray 5 by pulling it out frontward.

In this embodiment, the switchback unit U4 and the feeding roller assembly 75 of the printing unit U5 constitute a decurler for removing the roll set-induced curl of a cut sheet of printing paper P obtained by pulling a rolled sheet of printing paper P out of the magazine type storage 2 and cutting it into a predetermined length by the cutter 26. On the other hand, a single sheet of printing paper P transported from the cassette type storage 3, normally, is not curled. In this case, the decurler is not operated.

Specifically, the feeding roller assembly 75 in the printing unit U5 has a role as a holding member for holding the leading end of a sheet of printing paper P, which has been forwarded at the forwarding point by the roller pair 41 in the switchback unit U4, against movement. The roller pair 41 pinches the sheet of printing paper P in a position extending along the width of the sheet of printing paper P held by the feeding roller assembly 75.

To be more specific, after the roller pair 41 in the switchback unit U4 starts forwarding a cut sheet of printing paper P (a sheet of a rolled sheet of printing paper P cut in a predetermined length by the cutter 26), the feeding roller assembly 75 receives the forwarded cut sheet of printing paper P and pinches the leading end thereof (i.e., the trailing end thereof when received at the receive point). At the time, the feeding roller assembly 75 stops its operation and holds the leading end of the cut sheet of printing paper P against movement. At the stop of operation of the feeding roller assembly 75, the roller pair 41 in the switchback unit U4 pinches the vicinity of the leading end of the sheet of printing paper P held by the feeding roll 75.

Figure 7:
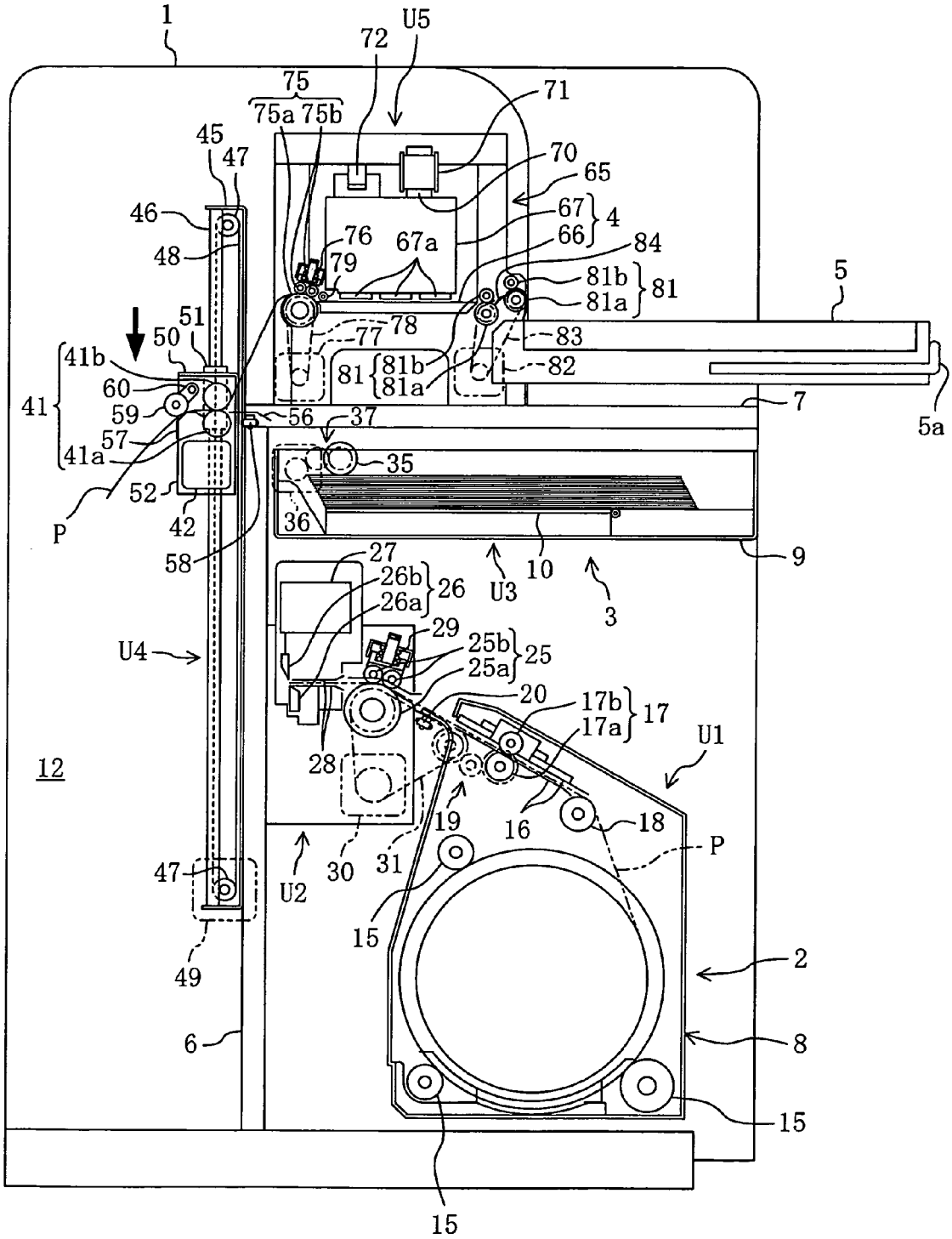
FIG. 7 is a corresponding view of FIG. 1 showing the inkjet printer when a sheet of printing paper is decurled.

Then, as shown in FIG. 7, with the leading end of the cut sheet of printing paper P held against movement by the feeding roller assembly 75, the moving mechanism in the switchback unit U4 vertically moves the roller pair 41 pinching the vicinity of the leading end of the same so that the drive roller 41*a* leads the way ahead of the driven roller 41*b*. As a result, the cut sheet of printing paper P is wound in a form bent opposite to the orientation of the curl on the upper, driven roller 41*b* of the roller pair 41 and a tension is applied to part of the cut sheet of printing paper P located between the feeding roller assembly 75 and the roller pair 41. This is because, since the cut sheet of printing paper P is curled owing to roll set so that its middle portion in the direction of transport rises on the printing surface side from both ends, it should be bent opposite to the orientation of the. curl by winding it on the driven roller 41*b* which is a roller toward the printing surface. For this purpose, the roller pair 41 is moved in a direction in which the drive roller 41*a* located opposite to the printing surface goes ahead of the other roller (i.e., downward), thereby winding the cut sheet of printing paper P on the driven roller 41*b*. With the movement of the roller pair 41, part of the cut sheet of printing paper P pinched by the roller pair 41 continuously shifts from the vicinity of its leading end toward its trailing end. During this time, the cut sheet of printing paper P is pulled in its length direction through between the roller pair 41 against drag (frictional resistance) thereof on the cut sheet while being bent with the rising side of the curl (the printing surface) inside. As a result, the cut sheet of printing paper P is decurled. The feeding roller assembly 75 is configured to hold the cut sheet of printing paper P without transporting it (against movement) during the decurling of the cut sheet of printing paper P.

The amount of decurl of the cut sheet of printing paper P made by the decurler can be controlled by changing the speed of downward movement of the roller pair 41 using the moving mechanism. In this case, as the moving speed of the roller pair 41 is decreased, the cut sheet of printing paper P is pulled more slowly through between the roller pair 41 so that the amount of decurl becomes larger.

Alternatively, the amount of decurl of the cut sheet of printing paper P may be controlled by changing the length of part of the cut sheet of printing paper P wound on the roller (driven roller 41*b* in this embodiment) during the movement of the roller pair 41 using the moving mechanism. In this case, as the length of part of the cut sheet of printing paper P wound on the driven roller 41*b* is increased, the amount of decurl becomes larger. Changing the length of part of the cut sheet of printing paper P wound on the driven roller 41*b* as described above can be implemented, for example, by providing a roller for pushing part of the cut sheet of printing paper P closer to the trailing end thereof than the drive roller 41*a* from the back of the cut sheet of printing paper P to bring it into contact with the driven roller 41*b* and changing the amount of contact.

Still alternatively, the amount of decurl of the cut sheet of printing paper P may be controlled by changing the diameter of the roller of the roller pair 41 on which the cut sheet of printing paper P is wound (i.e., the driven roller 41*b*). In this case, as the diameter of the driven roller 41*b* is decreased, the amount of decurl becomes larger. Changing the diameter of the roller as described above can be implemented, for example, by providing the roller with a plurality of parts of stepwise different diameters along the length of the roller and moving the roller in the length direction according to its desired part to be brought into contact with the cut sheet of printing paper P.

Still alternatively, the amount of decurl of the cut sheet of printing paper P may be controlled by changing the number of revolutions of the drive roller 41*a* of the roller pair 41 while driving the drive roller 41*a* during the downward movement of the roller pair 41 (i.e., during the decurling of the cut sheet of printing paper P). When the drive roller 41*a* is rotated in reverse (in the same direction as when the roller pair 41 forwards the cut sheet of printing paper P at the forwarding point), it is necessary to set the number of revolutions of the drive roller 41*a* and the moving speed of the roller pair 41 so that a desired tension is applied to the cut sheet of printing paper P. In this case, as the number of revolutions of the drive roller 41*a* is decreased, the tension applied to the cut sheet of printing paper P becomes greater so that the amount of decurl becomes larger. On the other hand, in the case where the drive roller 41*a* is rotated forward (in the same direction as when the roller pair 41 receives the cut sheet of printing paper P at the receive point and pulls it into the space 12), as the number of revolutions of the drive roller 41*a* is increased, the tension applied to the cut sheet of printing paper P becomes greater so that the amount of decurl becomes larger. If, out of both rollers of the roller pair 41, the roller on which the cut sheet of printing paper P is wound is driven as a drive roller, the amount of decurl of the cut sheet of printing paper P can be surely controlled by changing the number of revolutions of the roller.

The control of the amount of decurl may be carried out in a factory after the completion of the inkjet printer and before the shipping thereof or may be carried out freely by users. The inkjet printer itself may detect the amount of curl of the cut sheet of printing paper P and automatically control the amount of decurl.

Even if the trailing end of the cut sheet of printing paper P slips out from the roller pair 41, the roller pair 41 keeps on moving down and returns to the first receive point to receive the next sheet of printing paper P. In other words, the decurler is configured to decurl the cut sheet of printing paper P while the roller pair 41 moves from the forwarding point to the first receive point. In this respect, the distance between the downstream end of the cutter unit U2 and the upstream end of the printing unit U5, i.e., the distance L1 between the first receive point and the forwarding point (see FIG. 1), is selected to be equal to or longer than the length of the longest sheet of printing paper P cut by the cutter unit U2. In order to decurl the cut sheet of printing paper P substantially over the entire length, if, for example, the length of the longest cut sheet of printing paper P is longer than the distance L1, it is necessary to move the roller pair 41 downward beyond the first receive point and then return it to the first receive point. This, however, is not needed if the distance L1 is equal to or longer than the length of the longest cut sheet of printing paper P. In this manner, the operation of the roller pair 41 returning from the forwarding point to the first receive point can double as the operation thereof decurling the cut sheet of printing paper P.

The distance L1 is most preferably slightly longer than the length of the longest cut sheet of printing paper P. However, even if the distance L1 is shorter than the length of the longest cut sheet of printing paper P, use of the space for drooping the cut sheet of printing paper P as described above makes it possible to decurl the cut sheet of printing paper P substantially over the entire length without increasing the height of the housing 1. Therefore, it is not essential for the inkjet printer to have the distance L1 equal to or longer than the length of the longest cut sheet of printing paper P.

Figure 8:
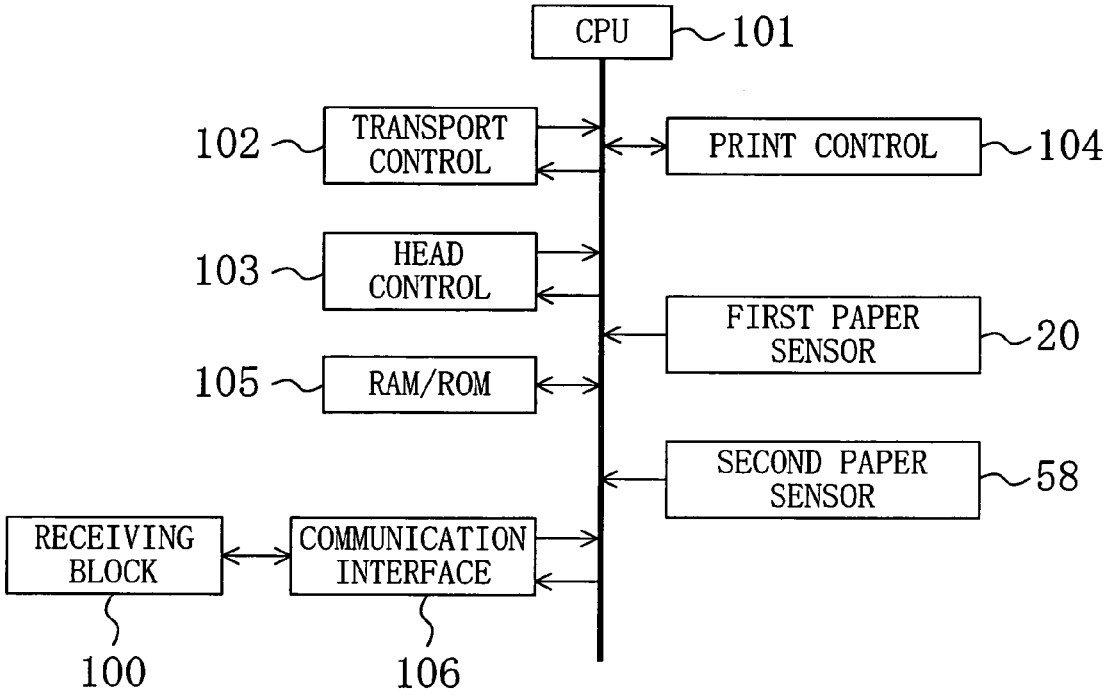
FIG. 8 is a block diagram showing the structure of a control system.

As shown in FIG. 8, the inkjet printer in this embodiment comprises, as a control system, a microprocessor (hereinafter, referred to as CPU) 101, a transport control unit 102, a head control unit 103, a print control unit 104, a semiconductor memory RAM/ROM 105, a communication interface 106, the above-mentioned first and second paper detecting sensors 20 and 58. The transport control unit 102, the head control unit 103, the print control unit 104, the semiconductor memory RAM/ROM 105, the communication interface 106, and the first and second paper detecting sensors 20 and 58 are connected to the CPU 101 through a data bus.

The transport control unit 102 controls the operations of the units U1 to U5 individually. The head control unit 103 controls the operation of the print head 67. The communication interface 106 transmits/receives information to/from the information receiving block 100. The print control unit 104 controls the printing of image on a sheet of printing paper P based on image data received from the information receiving block 100 via the communication interface 106.

The units U1 to U5 are operated in the following manner by the control of the transport control unit 102.

In printing on a sheet of printing paper P from the magazine type storage 2, the roller pair 41 in the switchback unit U4 is first positioned at the first receive point (see FIG. 1). Then, the support rollers 15 and the supply roller assembly 17 in the first supply unit U1 and the forwarding roller assembly 25 in the cutter unit U2 are operated to pull a rolled sheet of printing paper P out of the magazine type storage 2 and transport it to the roller pair 41 positioned at the first receive point.

When the leading edge of the rolled sheet of printing paper P is detected by the second paper detecting sensor 58, the drive roller 41*a* of the roller pair 41 starts to drive into counterclockwise rotation in FIGS. 1 and 2 (forward rotation), then receives the rolled sheet of printing paper P transported in a horizontal position toward the rear of the housing 1 from the cutter unit U2 and grips it. Specifically, the roller pair 41 pinches the rolled sheet of printing paper P between the drive and driven rollers 41*a* and 41*b*. The drive roller 41*a* further rotates to pull the rolled sheet of printing paper P into the space 12 located toward the rear of the housing 1. Then, when the rolled sheet of printing paper P is transported by a length determined according to the order information since its leading edge has been detected by the second paper detecting sensor 58, the movable blade 26*b* of the cutter 26 operates to cut the rolled sheet of printing paper P in a cut sheet of printing paper P. The drive roller 41*a* keeps on rotating after the cutting and then stops when the trailing end of the cut sheet of printing paper P is gripped by the roller pair 41. At this stage, the cut sheet of printing paper P gripped by the roller pair 41 is no longer placed on the first upstream transport line (cutter unit U2) and has already been separated from the first upstream transport line. The operations of the support rollers 15 and supply roller assembly 17 of the first supply unit U1 and the forwarding roller assembly 25 of the cutter unit U2 are stopped after the cutting of the rolled sheet of printing paper P.

Subsequently, the drive belt 48 of the switchback unit U4 operates so that the roller pair 41 gripping the cut sheet of printing paper P moves up and then stops at the forwarding point (see FIG. 5). In this manner, the cut sheet of printing paper P is transported from the first receive point to the forwarding point.

Figure 5:
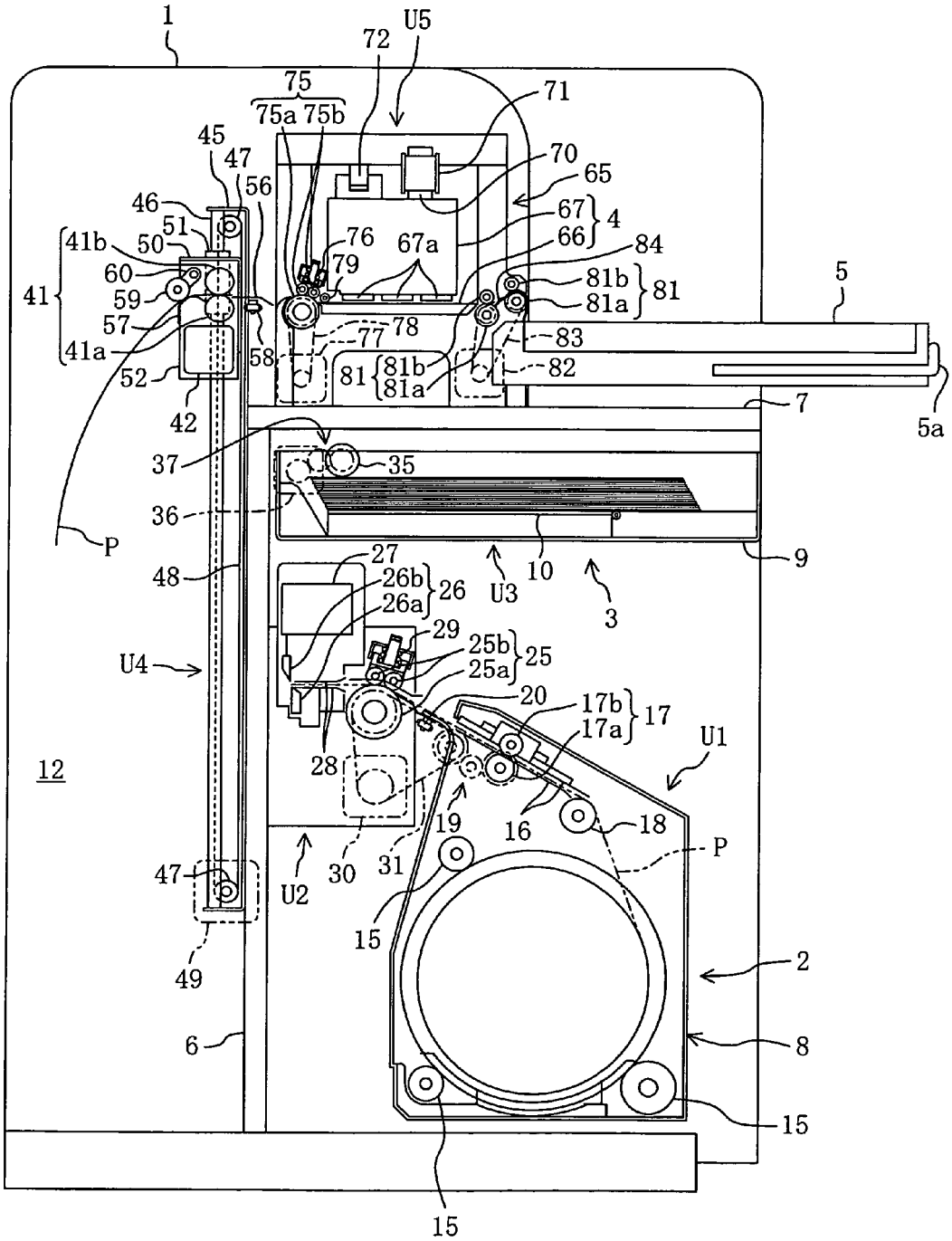
FIG. 5 is a corresponding view of FIG. 1 showing the inkjet printer when a roller pair of the switchback unit is at a forwarding point.

Thereafter, the drive roller 41*a* rotates clockwise in FIG. 5 (rotates in reverse) to forward the cut sheet of printing paper P in a horizontal position toward the front of the housing 1 to the feeding roller assembly 75 of the printing unit U5.

When the cut sheet of printing paper P is forwarded, its leading edge (trailing edge when received at the first receive point) is detected by the second paper detecting sensor 58. The feeding roller assembly 75 of the printing unit U5 operates concurrently with the above detection, and then stops when the cut sheet of printing paper P is forwarded by a predetermined length (the length up to the pinching of the leading end of the cut sheet of printing paper P between the feeding roller assembly 75) since the detection. As a result, the leading end of the cut sheet of printing paper P is held pinched against movement by the feeding roller assembly 75. Thereafter, the roller pair 41 pinching another part of the cut sheet of printing paper P is moved down with the leading end of the cut sheet of printing paper P held by the feeding roller assembly 75 as described above, thereby decurling the cut sheet of printing paper P (see FIG. 7). During the movement of the roller pair 41, the drive roller 41*a* may be rotated forward, rotated in reverse or held against rotation. Note that when the drive roller 41*a* is rotated in reverse, the number of revolutions of the drive roller 41*a* and the moving speed of the roller pair 41 must be suitably selected so that a tension can be applied to the cut sheet of printing paper P.

The trailing end of the cut sheet of printing paper P slips out from the roller pair 41 in due course. Since, in this embodiment, the length of the cut sheet of printing paper P is equal to or longer than the distance L1 between the first receive point and the forwarding point, the point at which the trailing end of the cut sheet of printing paper P slips out from the roller pair 41 is equal to or higher than the first receive point. Therefore, if the length of the cut sheet of printing paper P is shorter than the distance L1, the roller pair 41 keeps on moving down also after the slip-out of the trailing end of the cut sheet of printing paper P from the roller pair 41 and then returns to the first receive point. On the other hand, if a longer cut sheet of printing paper P than the distance L1 is subjected to decurling, the point at which the trailing end of the cut sheet of printing paper P slips out from the roller pair 41 will be lower than the first receive point. In this case, after the trailing end of the cut sheet of printing paper P slips out from the roller pair 41, the roller pair 41 moves up and returns to the first receive point.

After or before the roller pair 41 returns to the first receive point and after it passes through the point at which the trailing end of the cut sheet of printing paper P slips out from the roller pair 41, the feeding roller assembly 75 operates again to feed the cut sheet of printing paper P having held during the decurling onto the printing table 66. Then, while the feeding roller assembly 75 feeds the cut sheet of printing paper P intermittently in unit transport amounts, printing is carried out by moving the print head 67 in the main-scanning direction and ejecting ink from the ink ejection nozzles 67*b* of each head unit 67*a* of the print had 67 onto the cut sheet of printing paper P put on the printing table 66.

The printed cut sheet of printing paper P is ejected with the printing surface up to the outside of the housing 1 by the ejection roller assemblies 81 and received by the delivery tray 5.

Figure 6:
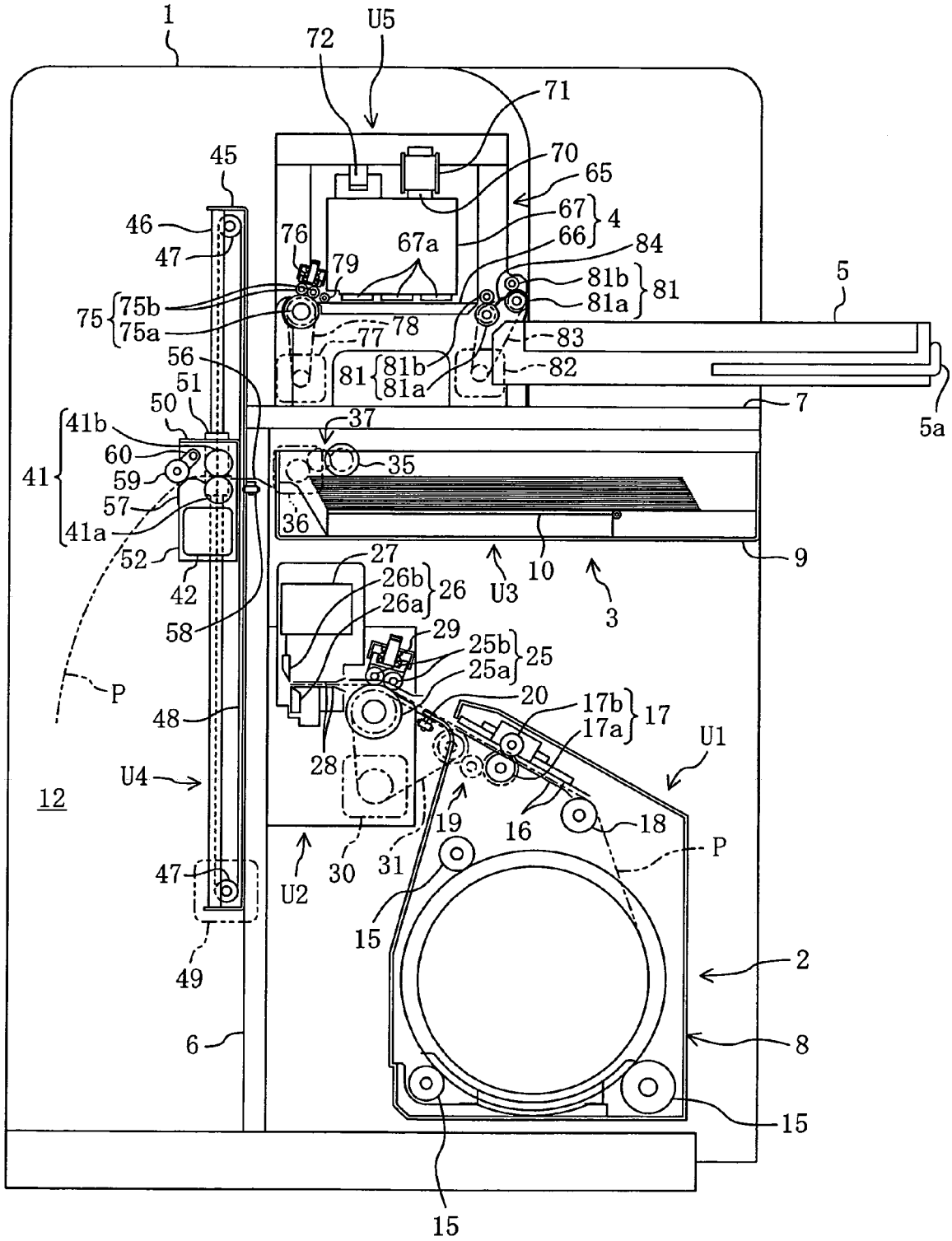
FIG. 6 is a corresponding view of FIG. 1 showing the inkjet printer when the roller pair of the switchback unit is at a second receive point.

On the other hand, in printing on the single sheets of printing paper P placed in the cassette type storage 3, the roller pair 41 of the switchback unit U4 is first positioned at the second receive point (see FIG. 6). Then, the forwarding roller 35 of the second supply unit U3 operates to pull one of the single sheets of printing paper P out of the cassette type storage 3 and transport it to the roller pair 41 positioned at the second receive point.

Then, like the cut sheet of printing paper P from the magazine type storage 2, the roller pair 41 grips the trailing end of the single sheet of printing paper P, moves up and then stops at the forwarding point. In this manner, the single sheet of printing paper P is transported from the second receive point to the forwarding point. Thereafter, the drive roller 41*a* of the roller pair 41 rotates in reverse to forward the single sheet of printing paper P in the direction opposite to the direction of movement during the receipt of it to the feeding roller assembly 75 of the printing unit U5.

When the single sheet of printing paper P is forwarded toward the feeding roller assembly 75, the leading edge of the single sheet of printing paper P is detected by the second paper detecting sensor 58. The feeding roller assembly 75 of the printing unit U5 operates concurrently with the above detection. Since the single sheets of printing paper P placed in the cassette type storage 3 need not be subjected to decurling, the feeding roller assembly 75 keeps on rotating without stopping, receives the single sheet of printing paper P forwarded by the switchback unit U4 and feeds it to the printing table 66 as it is. When the trailing edge of the single sheet of printing paper P is detected by the second paper detecting sensor 58, the roller pair 41 of the switchback unit U4 moves down and returns to the second receive point.

Subsequently, like the cut sheet of printing paper P from the magazine type storage 2, while the feeding roller assembly 75 feeds the single sheet of printing paper P intermittently in unit transport amounts, printing is carried out by moving the print head 67 in the main-scanning direction. The printed sheet of printing paper P is ejected with the printing surface up to the outside of the housing 1 by the ejection roller assemblies 81 and received by the delivery tray 5.

As described above, in this embodiment, the switchback unit U4 is provided as a paper carrier in which the roller pair 41 reciprocates between each of the first receive point corresponding to the downstream end of the first upstream transport line and the second receive point corresponding to the downstream end of the second upstream transport line and the forwarding point corresponding to the upstream end of the downstream transport line to carry a sheet of printing paper P. Therefore, either a cut sheet of a rolled sheet of printing paper P set in the magazine type storage 2 or one of single sheets of printing paper P set in the cassette type storage 3 can be selectively transported to the printing part 4, which provides an efficient printing process. Further, the first upstream transport line (i.e., the first supply unit U1 and the cutter unit U2), the magazine type storage 2, the second upstream transport line (i.e., the second supply unit U3), the cassette type storage 3, and the downstream transport line (i.e., the printing unit U5) can be arranged relatively flexibly.

Furthermore, the lengths of the first and second upstream transport lines can be shortened by the length for which the switchback unit U4 carries a sheet of printing paper P. Therefore, in spite of the fact that the first and second upstream transport lines are each composed of various types of rollers, its adverse effect on the position of a sheet of printing paper P being transported can be restrained. This allows different types of sheets of printing paper P coming from the two paper storages 2 and 3 to be transported in a uniform condition to the printing part 4 although the two upstream transport lines are placed separately from each other and have different lengths.

In this embodiment, the switchback unit U4 serving as a switchback device allows a sheet of printing paper P to be led from each of the first and second upstream transport lines to the downstream transport line while keeping the printing surface up. Therefore, even if the printing part 4 (or the downstream transport line) and the paper storages (or the first and second upstream transport lines) are arranged the former above the latter, the sheet of printing paper P can be transported to the printing part 4 without being significantly bent. Hence, a cut sheet of a rolled sheet of printing paper P is prevented from aggravating the curl. In addition, coupled with the structure in which a sheet of printing paper P is raised to higher levels than the top surface of the printing table 66 at both the upstream and downstream sides of the printing table 66, the sheet of printing paper P can obtain levelness without the need to provide a suction unit. Alternatively, the sheet of printing paper P in the printing part 4 can obtain a sufficient levelness with a simple, compact suction unit. Further, for the first transport line, the upstream transport line located upstream of the switchback unit U4 and the first receive point are located at higher levels than the roll center of a rolled sheet of printing paper P set in the magazine type storage 2. Therefore, coupled with that there is no need to bend back a cut sheet of the rolled sheet of printing paper P between the first upstream transport line and the downstream transport line, the first upstream transport line and the downstream transport line can be placed in proximity to each other (or can be placed in closer proximity to each other if the second upstream transport line is not provided between them), which makes the inkjet printer compact vertically as well as horizontally. As a result, the cut sheet of the rolled sheet of printing paper P in the printing part 4 can obtain levelness at low cost while the entire inkjet printer can be made compact. Furthermore, since a single sheet of printing paper P coming from the cassette type storage 3 is hardly bent, it can be prevented from being curled. Therefore, the single sheet of printing paper P in the printing part 4 can obtain a sufficient levelness with a simple, compact suction unit or even without any suction unit.

In this embodiment, the switchback unit U4 and the feeding roller assembly 75 placed at the upstream end of the downstream transport line constitute a decurler for decurling a cut sheet of a rolled sheet of printing paper P coming from the magazine type storage 2. Therefore, the cut sheet of the rolled sheet of printing paper P in the printing part 4 can obtain levelness with further certainty without the need to incorporate an additional decurler into the inkjet printer, which permits the retention of a high-level printing quality. In addition, since the decurler decurls the cut sheet of the rolled sheet of printing paper P by applying a tension to the cut sheet of the rolled sheet of printing paper P pinched and bent opposite to the orientation of the curl by the roller pair 41 and thereby pulling it in its length direction through between the roller pair 41 against drag of the roller pair 41 on the cut sheet, even a significantly curled cut sheet of printing paper P can be well decurled. As a result, the suction unit can be made further compact or can be surely dispensed with.

In this embodiment, the switchback unit U4 is configured so that the moving mechanism moves the roller pair 41 gripping a sheet of printing paper P to the forwarding point with the sheet of printing paper P separated from each of the first and second upstream transport lines. Therefore, when the sheet of printing paper P is fed onto the printing table 66 in the downstream transport line, it can have only a slight tilt with respect to the width of the printing table 66 and does not increase the tilt. If the sheet of printing paper P were transported by rollers only through from the paper storage to the printing part 4, it would be likely to skew even when the rollers had only slight errors. Particularly, if a large number of rollers were used to continuously transport a long sheet of printing paper P from the magazine type storage 2 to the printing part 4 without cutting it, the sheet of printing paper P being transported would be affected by the setting into the magazine type storage 2 and have a significantly large tilt on the printing table 66 coupled with the provision of the large number of rollers. Such a tilt of a sheet of printing paper P on the printing table 66 deteriorates the printing quality. Since, in particular, inkjet printers have a configuration in which ink ejection nozzles 67*b* are arranged in a line in the sub-scanning direction (the direction of transport of a sheet of printing paper P), the tilt of the sheet of printing paper P to the width of the printing table 66 would cause the points on the sheet of printing paper P corresponding to both ends of the nozzle line to become significantly misaligned each other in the main-scanning direction (the width direction of the printing table 66) and even a slight tilt of the sheet of printing paper P would have an effect on the printing quality. In contrast, since, in this embodiment, the switchback unit U4 is provided partway along the first transport line to receive at the first receive point a rolled sheet of printing paper P transported via the first upstream transport line, transport a cut sheet thereof, separated from the first upstream transport line, to the forwarding point and then feed it onto the printing table 66, the cut sheet of printing paper P on the printing table 66 is not affected by the setting into the magazine type storage 2. In addition, since the cut sheet of printing paper P is transported by the switchback unit U4, the length for which the cut sheet of printing paper P is transported by rolling of rollers can be reduced correspondingly and the number of rollers for transporting the cut sheet of printing paper P can be reduced. Further, since the switchback unit U4 is also placed partway along the second transport line, the tilt of a single sheet of printing paper P in the printing part 4 to the width of the printing table 66 can be reduced as with a cut sheet of a long rolled sheet of printing paper P. As a result, the tilt of the single sheet of printing paper P on the printing table 66 can be reduced thereby improving the printing quality.

In this embodiment, the printing part 4, the cassette type storage 3 and the magazine type storage 2 are arranged in this order in the direction of reciprocation of the roller pair 41, i.e., in the vertical direction. Therefore, the distance L1 between the forwarding point and the first receive point is relatively long, while the distance between the forwarding point and the second receive point is relatively short. This allows the operation of the roller pair 41 returning from the forwarding point to the first receive point to double as the operation thereof decurling a long cut sheet of a rolled sheet of printing paper P and allows the reduction of the time of transport of a single sheet of printing paper P because of a short distance of movement of the roller pair 41 from the forwarding point to the second receive point. As a result, the respective efficiencies of transport of the long cut sheet of the rolled sheet of printing paper P and a single sheet of printing paper P can be improved.

Further, if the distance L1 is equal to or longer than the length of the longest sheet of a rolled sheet of printing paper P cut by the cutter unit U2, this further improves the efficiency of transport of a sheet of printing paper P and in turn the efficiency of printing process. If the distance L1 were shorter than the length of the longest cut sheet of the rolled sheet of printing paper P, the roller pair 41 would have to move from the forwarding point past the first receive point to a lower point to decurl the longest cut sheet of the rolled sheet of printing paper P and then return from the lower point to the first receive point to receive the next sheet of printing paper P. In contrast, if, as in this embodiment, the distance L1 is equal to or longer than the length of the longest cut sheet of the rolled sheet of printing paper P, the roller pair 41 can complete the decurling of the longest cut sheet of the rolled sheet of printing paper P over the entire length simply by moving from the forwarding point to the first receive point. As a result, an ineffective movement of the roller pair 41 can be prevented thereby improving the efficiency of transport of a sheet of printing paper P.

Furthermore, in this embodiment, the distance H between the first receive point and the bottom of the space 12 is equal to or longer than the length of the longest sheet of a rolled sheet of printing paper P cut by the cutter unit U2. Therefore, when the rolled sheet of printing paper P, having been pulled out of the magazine type storage 2 and cut into a sheet of predetermined length by the cutter unit U2, is gripped in a drooping form by the roller pair 41 of the switchback unit U4, it does not touch the bottom of the housing 1 defining the space 12. As a result, a sheet of printing paper P can be prevented from producing creases and adsorbing contaminants, which avoids the deterioration of the printing quality.

Furthermore, since the first receive point corresponding to the downstream end of the cutter unit U2 is located above the roll center of a rolled sheet of printing paper P set in the magazine type storage 2, coupled with no need to bend back a cut sheet of the rolled sheet of printing paper P between each of the first and second upstream transport lines and the downstream transport line, each of the first and second upstream transport lines and the downstream transport line can be placed in proximity to each other, which makes the inkjet printer compact vertically as well as horizontally. In addition, since a void space is created behind the magazine type storage 2, it can be easily appropriated for the distance H between the first receive point and the bottom of the space 12, which makes the housing 1 vertically compact. Therefore, the inkjet printer can be entirely made compact while having a configuration supporting long prints (prints having relatively long lengths).

Since in this embodiment the magazine type storage 2, the cassette type storage 3 and the printing part 4 are arranged one above another and the roller pair 41 in the switchback unit U4 is configured to move vertically according to the vertical relation between these sections, the width and depth of the housing 1 can be shortened by making the housing 1 vertically long. In addition, since a sheet of printing paper P is moved in the front-to-rear direction of the housing 1, the width of the housing can be particularly shortened. Therefore, the printer can be easily placed in a narrow space.

Though in the above embodiment the housing 1 contains a single magazine type storage 2 and a single cassette type storage 3, it may contain two or more magazine type storages 2 and/or two or more cassette type storages 3.

Figure 9:
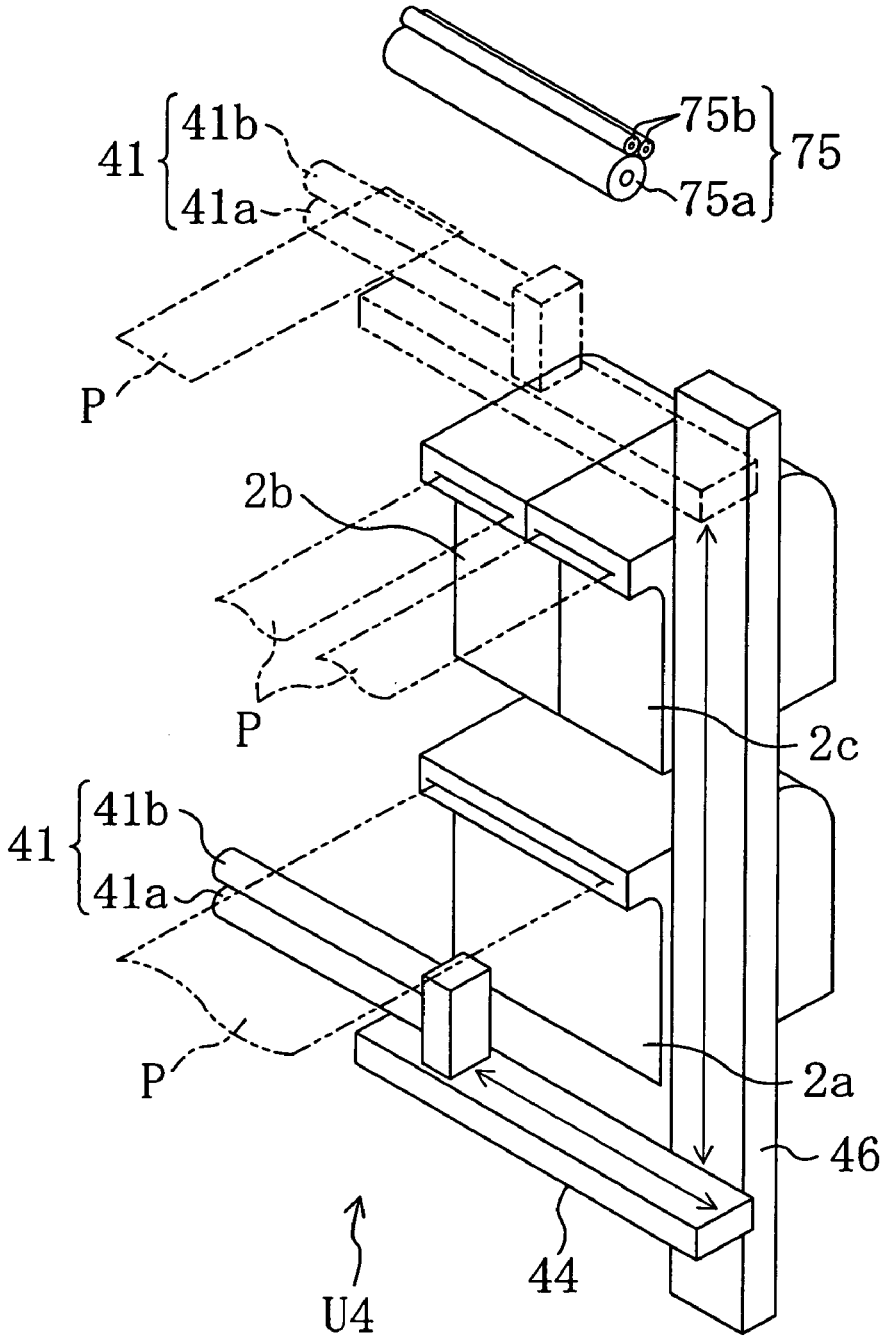
FIG. 9 is a schematic perspective view showing part of the structure of another inkjet printer of the present invention when viewed obliquely from behind the housing.

For example, FIG. 9 shows an exemplary inkjet printer having first to third magazine type storages 2*a*, 2*b* and 2*c* storing different widths of rolled sheets of printing paper P, respectively. In this inkjet printer, the first magazine type storage 2*a* is placed at a lower level in the housing 1 while the second and third magazine type storages 2*b* and 2*c* are placed side by side at a higher level in the housing 1. The provision of the switchback unit U4 enhances the flexibility of arrangement of the magazine type storages 2*a*, 2*b* and 2*c*. Therefore, in such a manner as shown in FIG. 9, two or more magazine type storages 2*a*, 2*b* and 2*c* can be vertically and horizontally aligned with each other.

Though in FIG. 9 cutter units U2 are not given, the cutter units U2 may be disposed behind the magazine type storages 2*a*, 2*b* and 2*c* or in their inner spaces, respectively.

In the inkjet printer shown in FIG. 9, owing to the side-by-side arrangement of the second and third magazine type storages 2*b* and 2*c*, the roller pair 41 in the switchback unit U4 (paper carrier) is configured to laterally reciprocate along a horizontal rail 44 and the horizontal rail 44 is configured to vertically reciprocate along the vertical rail (track rail) 46. Thus, the roller pair 41 can reciprocate laterally as well as vertically.

With the above configuration, when sheets of printing paper P pulled out of the second and third magazine type storages 2*b* and 2*c* are received at second and third receive points, respectively, the middle of each sheet of printing paper P in the width direction is misaligned with the middle of the printing table 66 in the width direction (the middle thereof in the main-scanning direction). Since, however, the roller pair 41 can reciprocate vertically and laterally, the middle of each cut sheet of the rolled sheets of printing paper P in the width direction can be aligned with the middle of the printing table 66 when it reaches the forwarding point (see the feeding roller assembly 75 in FIG. 9) and therefore the cut sheet of printing paper P can be fed to the printing part (not shown in FIG. 9).

With the inkjet printer shown in FIG. 9, as with the inkjet printer shown in FIG. 1, cut sheets obtained from rolled sheets of printing paper P set in the magazine type storages 2*a*, 2*b* and 2*c*, respectively, can be selectively transported to the printing part 4 according to the order information while the magazine type storages 2*a*, 2*b* and 2*c* can be relatively flexibly arranged. In addition, the lengths of the associated upstream transport lines for the magazine type storages 2*a*, 2*b* and 2*c* can become relatively short. Further, with the inkjet printer shown in FIG. 9, the associated upstream transport lines for the first to third magazine type storages 2*a*, 2*b* and 2*c* can have equal lengths, which restrains the conditions of transport of a sheet of printing paper P from differing among the plurality of upstream transport lines. Therefore, the printing quality can be uniformed. In other words, the printing quality for the particular type of cut sheet of printing paper P can be prevented from being deteriorated relative to that for the other types of cut sheets of printing paper P.

In the structure of an inkjet printer in which paper storages are arranged side by side as shown in FIG. 9, it is not essential to configure the roller pair 41 to be reciprocable vertically and laterally. For example, if the roller pair 41 has such a long length that can grip a sheet of printing paper P at each of the second and third receive points arranged side by side, cut sheets obtained from rolled sheets of printing paper P set in the paper storages, respectively, can be selectively transported even though the switchback unit is only vertically reciprocable (i.e., even it is the switchback unit U4 shown in FIGS. 2 and 3). In this case, the middle of each cut sheet of the rolled sheets of printing paper P in the width direction is misaligned with the middle of the printing table 66. However, this can be coped with by controlling printing according to where the cut sheet on the printing table 66 is positioned in the main-scanning direction.

In the above embodiment, owing to the fact that the magazine type storage 2, the cassette type storage 3 and the printing part 4 are arranged one above another and in turn the first and second receive points and the forwarding point are vertically aligned, the switchback unit U4 is configured so that the roller pair 41 vertically reciprocates. The switchback unit U4 in the present invention, however, is not limited to the above configuration but may be configured according to the arrangement of the first and second receive points and the forwarding point. For example, if two or more paper storages and a printing part are arranged side by side so that two or more receive points and the forwarding point are horizontally aligned, the switchback unit U4 may be configured so that the roller pair 41 horizontally reciprocates.

In the above embodiment, the roller pair 41 constitutes a gripping member for receiving a sheet of printing paper P from each of the upstream transport lines and gripping it in the switchback unit U4. The gripping member in the present invention, however, is not particularly limited so long as it can grip a sheet of printing paper P by pinching it from both sides in the thickness direction. In these cases, it is necessary to additionally provide a pull-in/forward means for pulling in and forwarding the sheet of printing paper P, such as a roller assembly.

In the above embodiment, the number of cassette type storages 3 contained in the housing 1 is one. However, the number of cassette type storages 3 may be two or more. In these cases, it is preferable that plurality types of single sheets of printing paper P of different lengths are set in two or more cassette type storages 3, respectively, and the cassette type storages 3 are arranged from top down in order of increasing length of single sheets of printing paper P set therein. In this manner, the receive point for a single sheet of printing paper P of longer length is at a relatively higher level, while the receive point for a single sheet of printing paper P of shorter length is at a relatively lower level. Therefore, a space behind the cassette type storages 3 arranged one above another can be used as the space 12 (space in which a sheet of printing paper P gripped by the roller pair 41 droops), which makes the housing 1 vertically compact. Further, the number of magazine type storages 2 contained in the housing 1 may be two or more.

Figure 10:
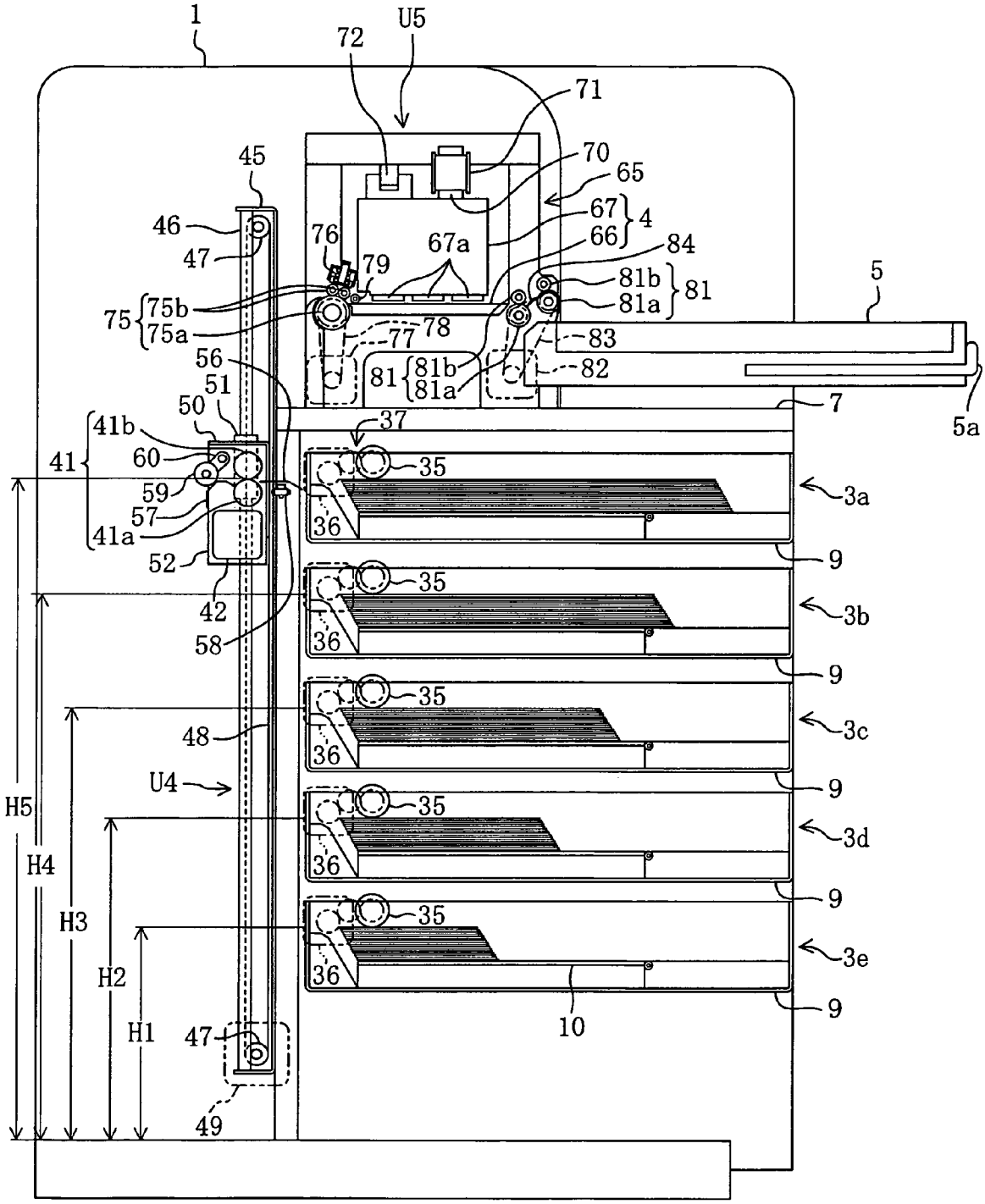
FIG. 10 is a corresponding view of FIG. 1 showing the structure of still another inkjet printer of the present invention.

Furthermore, the above inkjet printer may include no magazine type storage but include two or more cassette type storages, for example, first to fifth cassette type storages 3*a* to 3*e* as shown in FIG. 10. The first to fifth cassette type storages 3*a* to 3*e* are arranged from top down in order of increasing length of single sheets of printing paper P set therein. The distances between the bottom of the space 12 and each of the downstream ends of the upstream transport lines connecting to the cassette type storages 3*a* to 3*e*, respectively, i.e., the distances H1 to H5 between the bottom of the space 12 and each of the first to fifth receive points, are selected to become equal to or longer than the length of a single sheet of printing paper P received at each receive point. In this manner, when the roller pair 41 in the switchback unit U4 grips a single sheet of printing paper P, the received sheet of printing paper P does not touch the bottom of the housing 1. In addition, since the first to fifth cassette type storages 3*a* to 3*e* are arranged from top down in order of increasing length of single sheets of printing paper P set therein, single sheets of printing paper P of relatively long length are set in a cassette type storage located at a relatively high level (for example, the first or second cassette type storage 3*a* or 3*b*). Therefore, the space behind the first to fifth cassette type storages 3*a* to 3*e* can be used as the space 12, which makes the housing 1 vertically compact.

The order of arrangement of the magazine type storage 2 and the cassette type storage 3 is not particularly limited. For example, in the case of arranging the storages 2 and 3 one above another, the magazine type storage 2 may be placed below one or more cassette type storages 3 and the receive point corresponding to the downstream end of the upstream transport line connecting to the magazine type storage 2 may be located above the roll center of a rolled sheet of printing paper P set in the magazine type storage 2. Thus, a void space having a height corresponding to the size (roll diameter) of the rolled sheet of printing paper P in the magazine type storage 2 is created on the opposite side of the roller pair 41 to the magazine type storage 2. This void space can be effectively used as the space 12.

Alternatively, one or more cassette type storages 3 may be placed below the magazine type storage 2. Since the magazine type storage 2 is thus located at a relatively high level, the downstream end of the upstream transport line connecting to the magazine type storage 2 becomes relatively high. Therefore, a space created on the opposite side of the roller pair 41 to the cassette type storages 3 can be used as the space 12. Hence, the inkjet printer can be made vertically compact while supporting printing on considerably long sheets of printing paper P.

In the above embodiment, the decurling is implemented by moving the roller pair 41 from the forwarding point downward (toward the first receive point at which a cut sheet of printing paper P has been received). If the cut sheet of printing paper P is curled in the opposite direction to the case in the above embodiment (the middle portion thereof in the direction of transport rises on the back side from both ends), the decurling can be implemented by moving the roller pair 41 from the forwarding point upward (in the direction away from the first receive point). In this case, the cut sheet of printing paper P is wound on the lower roller of the roller pair 41, i.e., the drive roller 41*a*, in a form bent opposite to the orientation of the curl.

In the above embodiment, the feeding roller assembly 75 for receiving a sheet of printing paper P forwarded by the roller pair 41 and feeding it to the printing part 4 is used as the holding member constituting part of the decurler. The holding member is not limited to this but may be other types of holding members, such as a gripping member for gripping the sheet of printing paper P in the thickness direction.

In the above embodiment, the paper carrier is constituted by the switchback unit U4 serving as both the switchback device and the decurler. The paper carrier in the present invention may not have the functions of the switchback device and the decurler. For example, the downstream transport line may be disposed on the opposite side of the roller pair 41 to the plurality of upstream transport lines. In this case, the paper carrier forwards, at the forwarding point, a sheet of printing paper P in the same direction as the direction of movement thereof during receipt. Specifically, the paper carrier has a gripping member which can reciprocate, by means of a moving mechanism, between any of the first to n-th receive points (where n is a natural number greater than one) and the forwarding point corresponding to the upstream end of the downstream transport line. The paper carrier is configured so that the gripping member receives, at one of the first to n-th receive points, a sheet of printing paper P transported from the associated upstream transport line and grips it, the moving mechanism moves the gripping member from the receive point to the forwarding point and the gripped sheet of printing paper P is then forwarded at the forwarding point to the downstream transport line.

A decurler can be easily configured using the paper carrier of the present invention. Specifically, the decurler can be implemented by disposing, at the upstream end of the downstream transport line, a holding member for holding the leading end of a sheet of printing paper P forwarded from the paper carrier at the forwarding point, using the holding member to hold the leading end of the sheet of printing paper P being forwarded to the downstream transport line and, in this state, using a moving mechanism to move the roller pair 41, which pinches the vicinity of the leading end of the sheet of printing paper P, from the forwarding point toward or away from the receive point where the sheet of printing paper P has been received. In the above embodiment, the moving mechanism moves up and down the roller pair 41. The direction of movement of the roller pair 41 (in other words, the direction in which the rollers of the roller pair 41 are opposed to each other) in the present invention is not limited to this but may be selected suitably depending on the relative position of the paper carrier, the holding member, the upstream transport line (or lines) and the downstream transport line. However, the arrangement of these components in the above embodiment is preferable in view of compactness of the entire inkjet printer.

Further, in the above embodiment, the inkjet printer of the present invention is for photo printing systems. The present invention, however, is applicable to any inkjet printer for transporting a sheet of printing paper (a cut sheet of a long rolled sheet of printing paper or a single sheet of printing paper) from a paper storage to a printing part.

What is claimed is:

1. An inkjet printer comprising:

first to n-th paper storages in each of which a sheet or sheets of printing paper are set, where n is a natural number larger than 1;

first to n-th upstream transport lines, associated with the first to n-th paper storages, respectively, for individually pulling the sheet of printing paper out of the first to n-th paper storages and transporting the pulled-out sheet of printing paper;

a printing part for printing on the printing surface of the sheet of printing paper transported;

a single downstream transport line for transporting the sheet of printing paper to the printing part; and a paper carrier having a gripping member reciprocable between any of first to n-th receive points corresponding to the downstream ends of the first to n-th upstream transport lines, respectively, and a forwarding point corresponding to the upstream end of the downstream transport line by means of a moving mechanism, wherein the paper carrier is configured so that the gripping member receives and grips, at one of the first to n-th receive points, the sheet of printing paper transported from the associated upstream transport line, the moving mechanism moves the gripping member from said one receive point to the forwarding point and the gripped sheet of printing paper is forwarded at the forwarding point to the downstream transport line;

wherein the first to n-th upstream transport lines are arranged one above another and configured to transport the sheet of printing paper with the printing surface up, the downstream transport line is located above the first to n-th upstream transport lines and configured to transport the sheet of printing paper with the printing surface up in the direction opposite to the direction of transport in the upstream transport lines, and the paper carrier is configured so that the gripping member receives and grips, at one of the first to n-th receive points, the sheet of printing paper transported from the associated upstream transport line, the moving mechanism moves the gripping member from the receive point to the forwarding point located above the receive point and the gripped sheet of printing paper is forwarded at the forwarding point to the downstream transport line in the direction opposite to the direction of movement of the sheet of printing paper during receipt thereof.

2. An inkjet printer comprising;

first to n-th paper storages in each of which a sheet or sheets of printing paper are set, where n is a natural number larger than 1;

first to n-th upstream transport lines, associated with the first to n-th paper storages, respectively, for individually pulling the sheet of printing paper out of the first to n-th paper storages and transporting the pulled-out sheet of printing paper;

a printing part for printing on the printing surface of the sheet of printing paper transported;

a single downstream transport line for transporting the sheet of printing paper to the printing part; and a paper carrier having a gripping member reciprocable between any of first to n-th receive points corresponding to the downstream ends of the first to n-th upstream transport lines, respectively, and a forwarding point corresponding to the upstream end of the downstream transport line by means of a moving mechamism, wherein the paper carrier is configured so that the gripping member receives and grips, at one of the first to n-th receive points, the sheet of printing paper transported from the associated upstream transport line, the moving mechanism moves the gripping member from said one receive point to the forwarding point and the gripped sheet of printing paper is forwarded at the forwarding point to the downstream transport line;

wherein at least one of the first to n-th paper storages is a magazine type storage in which a long rolled sheet of printing paper is set, the upstream transport line for pulling the rolled sheet of printing paper out of the magazine type storage is provided with a cutter for cutting the rolled sheet of printing paper in a cut sheet of printing paper of predetermined length, the gripping member in the paper carrier is a roller pair composed of opposed rollers which are rotatable forward and in reverse around the respective central axes thereof and pinch the sheet of printing paper transported from the associated upstream transport line, the downstream transport line is provided at the upstream end with a holding member for holding the leading end of the sheet of printing paper forwarded at the forwarding point from the paper carrier, and the paper carrier is configured so that after the sheet of printing paper cut in the predetermined length by the cutter starts to be forwarded from the forwarding point toward the downstream transport line, the moving mechanism moves the roller pair pinching the vicinity of the leading end of the cut sheet of printing paper, with the leading end of the cut sheet of printing paper of the predetermined length held by the holding member, from the forwarding point toward or away from the receive point where the cut sheet of printing paper has been received to pull the cut sheet of printing paper in a length direction thereof through between the roller pair against drag of the roller pair on the cut sheet to shift the part of the cut sheet of printing paper pinched by the roller pair from the vicinity of the leading end thereof toward the trailing end thereof thereby removing curl of the cut sheet of printing paper due to roll set.

* * * * *